US005962152A

United States Patent [19]

Nakamura et al.

[11] Patent Number: 5,962,152

[45] Date of Patent: Oct. 5, 1999

[54] CERAMIC HEAT INSULATING LAYER AND PROCESS FOR FORMING SAME

[75] Inventors: Masateru Nakamura, Susono; Sumio Kamiya, Toyota, both of Japan

[73] Assignee: Toyota Jidosha Kabushiki Kaisha, Toyota, Japan

[21] Appl. No.: 08/864,344

[22] Filed: May 28, 1997

[30] Foreign Application Priority Data

May 31, 1996 [JP] Japan ..... 8-159116

[51] Int. Cl.[6] ..... B32B 15/04; B05D 1/38; B05D 3/02

[52] U.S. Cl. ..... 428/633; 428/469; 428/470; 428/471; 428/701; 427/380; 427/419.2; 427/419.3

[58] Field of Search ..... 428/632, 633, 428/678, 681, 684, 685, 469, 470, 471, 701; 427/380, 419.2, 419.3, 376.5

[56] References Cited

U.S. PATENT DOCUMENTS

| | | | |
|---|---|---|---|
| 3,013,897 | 12/1961 | Cupery et al. | 117/41 |
| 3,954,512 | 5/1976 | Kanter | 148/6.35 |
| 4,221,697 | 9/1980 | Osborn et al. | 260/42.53 |
| 5,164,003 | 11/1992 | Bosco et al. | 106/287.1 |
| 5,330,794 | 7/1994 | Bosco et al. | 427/387 |
| 5,436,083 | 7/1995 | Haluska et al. | 428/685 |
| 5,783,622 | 7/1998 | Sabata et al. | 524/444 |

FOREIGN PATENT DOCUMENTS

| | | |
|---|---|---|
| 61-26781 | 2/1986 | Japan . |
| 7-316838 | 12/1995 | Japan . |

OTHER PUBLICATIONS

Hideki Nishimori, et al., Journal of the Ceramic Society of Japan, International Edition, vol. 103, No. 7, pp. 731–733, Jul. 1995, "Dispersity and Size of Silica Particles Constructing Thick Films Prepared By Electrophoretic Sol–Gel Deposition".

Patent Abstracts of Japan, vol. 8, No. 232 (C–248), and Derwent Abstracts, AN 84–198178, JP 59–113051, Jun. 29, 1984.

S. Kamiya, et al., "Ceramic Coating Material for Thermal Insulation", Toyota Technical Review, vol. 46, No. 1, May 1996, pp. 138–143 (English Version (Sep. 1996) attached).

*Primary Examiner*—John J. Zimmerman

*Attorney, Agent, or Firm*—Oblon, Spivak, McClelland, Maier & Neustadt, P.C.

[57] ABSTRACT

A ceramic heat insulating layer formed on an iron-based base material with or without a bonding layer interposed therebetween, comprising: aggregate particles of a nepheline mineral; and a binder composed of silica particles and of a metalloxane polymer, the binder filling spaces between the aggregate particles and chemically bonding the aggregate particles to each other and to the base material or to the bonding layer. Alternatively, the binder leaves voids between the aggregate particles, and a sealing layer seals the voids in a surface region of the ceramic heat insulating layer. A process of forming the ceramic heat insulating layer comprises mixing aggregate particles of a nepheline mineral, a binder of an alcoxide and an organosilicasol, and a dispersing medium to form a slurry; applying the slurry either on the surface of an iron-based base material, or on any bonding layer formed on the surface; and firing the iron-based base material having the applied slurry; wherein the mixing is either carried out in a sufficiently acidic or sufficiently alkaline solution such that the surface potential of particles dispersed in the slurry does not pass an isoelectric point due to an increase in a pH value of the slurry because of alkaline metal ions dissolved from the aggregate particles of the nepheline mineral, or the mixing is carried out after coating the aggregate particles of the nepheline mineral with a coating layer which prevents dissolution of alkaline metal ions from the aggregate particles of the nepheline mineral.

17 Claims, 18 Drawing Sheets

CERAMIC HEAT INSULATING LAYER AND PROCESS FOR FORMING SAME

BACKGROUND OF THE INVENTION

1. Field of the Invention

The present invention relates to a ceramic heat insulating layer formed on an iron-based base material with or without an interposed bonding layer therebetween, and to a process for forming the heat insulating layer.

2. Description of the Related Art

It is known in the art that a ceramic layer having good heat resistance and heat insulation efficiency can be formed on an iron-based structural member in which the heat resistance and the heat insulation are necessary, such as the cylinder, piston, cylinder head, and other members of the exhaust system of diesel engines, gasoline engines, and other internal combustion engines.

Japanese Unexamined Patent Publication (Kokai) No. 61-26781 proposed forming a ceramic layer mainly composed of oxides of Fe, Al and Cr on a base material made of a iron-based metal or alloy such as cast iron forming part of an internal combustion engine, which part is exposed to high temperatures. The ceramic layer preferably comprises $Fe_2O_3$, $Fe_2O_3$-Cr, or other iron oxide-based ceramic having a linear thermal expansion coefficient close to that of the iron-based base material.

The proposed iron oxide-based ceramic layer, however, has a drawback in that, at service temperatures of 900° C. or higher, a reduction reaction of $Fe_2O_3$ and a sintering shrinkage occur to cause cracking of the ceramic layer and/or exfoliation of the ceramic layer from the base material or from the bonding layer formed on the base material.

To eliminate this drawback, it is necessary to form a heat insulating layer which is stable at temperatures of 900° C. or higher, has a thermal expansion coefficient comparable with or greater than that of the iron-based base material, and has a thermal conduction coefficient comparable with or less than that of the iron oxide-based ceramic.

Nepheline minerals (typically, $NaAlSiO_4$) have been considered to have an optimal property to form an aggregate of the above-mentioned heat insulating layer.

Nepheline minerals, however, cannot be practically used because, when preparing a slurry from a nepheline mineral powder, alkaline metal ions (typically, $Na^+$) of the nepheline mineral cause rapid progress of both agglutination of the powder particles and reaction of a binder, and therefore, controlled preparation of slurry cannot actually be realized on commercial scale.

Even on laboratory scale, there is still a problem that, at service temperatures of 1000° C. or higher, the nepheline mineral aggregate sinters and the ceramic layer then shrinks to cause cracking and exfoliation of the ceramic layer to occur.

SUMMARY OF THE INVENTION

The object of the present invention is to solve the above-mentioned conventional problems and to provide a ceramic heat insulating layer containing a nepheline mineral as an aggregate, having a thermal expansion coefficient comparable with that of the iron-based base material, having an improved strength of bonding to the iron-based base material or to a bonding layer interposed between the ceramic layer and the base material, and having an improved heat resistance and strength, and also to provide a process for forming the ceramic heat insulating layer.

To achieve the object according to one aspect of the present invention, there is provided a ceramic heat insulating layer formed on an iron-based base material with or without a bonding layer interposed therebetween, comprising:

aggregate particles of a nepheline mineral, and a binder composed of silica particles and of a metalloxane polymer, the binder filling spaces between the aggregate particles and chemically bonding the aggregate particles to each other and to the base material or to the bonding layer.

The ceramic heat insulating layer contains an aggregate of a nepheline mineral having a heat resistance at temperatures of 1000° C. or higher and a high thermal expansion coefficient comparable with that of an iron-based base material, to ensure an improved heat resistance and to prevent cracking and exfoliation due to a difference in thermal expansion coefficient relative to the iron-based base material; contains a binder composed of silica particles and a metalloxane polymer, which binder fills spaces between the aggregate particles, to ensure a good heat resistance while providing a buffer against a sintering shrinkage of the aggregate, thereby preventing cracking and exfoliation at high temperatures of 1000° C. or higher, the binder also chemically bonding the aggregate particles to each other and to the base material or to the interposed bonding layer, to ensure an improved strength.

According to another aspect of the present invention, the ceramic heat insulating layer may contain a binder which intervenes between the aggregate particles leaving unfilled pores or voids between the aggregate particles, except for the surface region of the ceramic layer in which the voids are sealed with a sealing layer. In this structure, the voids left between the aggregate particles preserve air in the ceramic layer while the voids are isolated by the sealing layer from the environment to provide an improved heat insulation.

For either of the above-mentioned aspects of the present invention, there is also provided a process of forming a ceramic heat insulating layer on an iron-based base material, comprising the steps of:

mixing aggregate particles of a nepheline mineral, a binder of an alcoxide and an organosilicasol, and a dispersing medium to form a slurry, applying the slurry either on the surface of an iron-based base material, or on a bonding layer formed on the surface, and firing the iron-based base material having the applied slurry, wherein the mixing is either carried out in a sufficiently acidic or sufficiently alkaline solution such that the surface potential of particles dispersed in the slurry does not pass an isoelectric point due to an increase in pH value of the slurry because of alkaline metal ions dissolved from the aggregate particles of the nepheline mineral, or the mixing is carried out after coating the particles of the nepheline mineral with a coating layer which prevents dissolution of alkaline metal ions from the aggregate particles of the nepheline mineral.

The process of forming a ceramic heat insulating layer of the present invention utilizes a sol-gel process, including applying a slurry in a sol state on the surface of a base material, causing the applied layer of the slurry to gel, and firing the thus-formed gel layer to form a ceramic layer.

In the conventional art, during this process, alkaline metal ions (typically, $Na^+$) from a nepheline mineral cause agglutination of particles in the slurry to occur in a very short time and gelation proceeds rapidly, so that controlled preparation of a slurry cannot actually be carried out and a ceramic heat insulating layer utilizing a nepheline mineral was not practically realized.

The basic concept of the present invention is that the agglutination of particles in a slurry, or the gelation of the slurry, proceeds rapidly because alkaline metal ions from a nepheline mineral increases the pH value of the slurry, during which the surface potential of particles in the slurry passes an isoelectric point to cause agglutination of particles.

In one aspect, the process of the present invention uses a slurry which is either sufficiently acidic to overcome or cancel the increase in pH value due to the alkaline metal ions from the nepheline mineral, or is sufficiently alkaline to provide an initial pH value on an alkaline side, to prevent the surface potential of particles in the slurry from passing the isoelectric point.

In another aspect of the process of the present invention, particles of the nepheline mineral are coated, prior to the preparation of slurry, to prevent dissolution of the alkaline metal ions from the particles.

According to any of these aspects, the gelation during preparation of a slurry can be substantially delayed so that controlled preparation of a slurry on commercial scale can be practically achieved to provide a ceramic heat insulating layer utilizing a nepheline mineral as an aggregate and having an improved heat resistance and strength.

In the ceramic heat insulating layer of the present invention, particles of a nepheline mineral form an aggregate and spaces between the aggregate particles are filled with a binder composed of silica particles and a metalloxane polymer which also chemically bonds the aggregate particles to each other and to a base material, or to any bonding layer formed on the base material.

The term "metalloxane" is herein used as a generic name of the chemical compounds having M-O bonds and consisting of a metal M, oxygen O, and hydrogen. The metal M is not necessarily limited but may be any metal which cooperates with the silica particles to chemically bond the aggregate particles of a nepheline mineral to each other and to the base metal, or to any bonding layer formed on the base metal to provide good stability at high temperatures of 900° C. or higher, preferably 1000° C. or higher. From the viewpoint of easy handling, those chemical compounds in which polycondensation does not proceed rapidly but proceeds slowly are preferred.

Siloxane is one of the most preferred embodiments of metalloxane, which contains Si as the metal M and has Si—O bonds, i.e., siloxane bonds. Siloxane may preferably be produced from tetraethoxysilane (TEOS), in which polycondensation is easy to control.

Polycondensation of tetraethoxysilane can be easily controlled to selectively produce either linear or spherical siloxane polymers. A linear siloxane polymer provides a stiff ceramic heat insulating layer. In contrast, a spherical siloxane polymer has a relatively lower stiffness and is suitably used to provide a buffer against sintering shrinkage where it is significant.

A ceramic heat insulating layer having the aggregate particles of a nepheline mineral according to the present invention may not be directly formed on a base material but may be formed on a bonding layer formed on the base material in order to provide a further strengthened bond to the base material. The bonding layer is typically composed of a Fe—Ni alloy and a Cr oxide. In this case, the ceramic heat insulating layer also preferably contains a Cr oxide. To this end, a Cr powder is added in the slurry for forming the ceramic heat insulating layer.

A strengthened bond to the base material can also be achieved without forming a bonding layer by an alternative method including initially applying a slurry directly on a base material, drying the applied layer, then firing in an inert atmosphere to cause formation of a dense oxide layer chemically bonded to the base material while a ceramic heat insulating layer of the present invention is formed on the dense oxide layer. This provides an improved bond strength between the base material and the ceramic heat insulating layer because the dense oxide film protects the base material from oxidation to prevent exfoliation of the ceramic layer due to oxidation of the base material and because the bond between the ceramic layer and the base material is substantially effected by chemical bonding through the dense oxide film.

In the above-mentioned embodiment, in which a bonding layer containing a Cr oxide is not formed on the base material, a ceramic heat insulating layer need not contain Cr oxides. Because Cr oxides have a heat conduction coefficient of about 150 times that of nepheline minerals, the absence of Cr oxides advantageously provides an improved heat insulation of the ceramic heat insulating layer. Moreover, because Cr oxides exhibit green color whereas nepheline minerals are white, the absence of Cr oxides also advantageously reduces radiant heat absorption to further improve the heat insulation.

In the preparation of a slurry for forming a ceramic heat insulating layer according to the present invention, the rapid gelation of the slurry caused by alkaline metal ions dissolved from a nepheline mineral is prevented either by (1) the mixing of a binder and an aggregate is performed in (a) an acidic solution or (b) an alkaline solution, or by (2) coating particles of a nepheline mineral with a suitable coating layer to prevent dissolution of alkaline metal ions from the nepheline mineral particles.

In case (1)-(a), the aggregate particles of a nepheline mineral are agitated in an acid solution to form a suspension, prior to being mixed with a binder, to prevent the surface potential of the aggregate particles from reaching an isoelectric point in the process of the increase in pH of the slurry because of alkaline metal ions.

The acid solution is advantageously composed of a carboxylic acid and an alcohol containing a small amount of an inorganic acid to form an alkaline metal salt of alkaline metal ions from a nepheline mineral and an ester, which salt acts as a surfactant to improve the dispersivity and stability of a slurry while preventing retention of inorganic salts other than the binder sources to provide an improved strength of a ceramic heat insulating layer.

From this point of view, it is preferred that the carboxylic acid may be composed of an anhydrous carboxylic acid which does not cause formation of inorganic acids, or may further contain at least one selected from the group consisting of polyamine, polyphosphine, and polyether, to fix alkaline metal ions from a nepheline mineral as a chelate complex, thereby substantially improving the dispersivity and stability of a slurry.

In case (1)-(b), the pH value of a dispersed liquid composed of the binder and the dispersing medium is suitably adjusted to 8 or greater, prior to the mixing step. This holds the pH value of the dispersed liquid on the alkaline side to prevent the surface potential of the dispersed particles from passing an isoelectric point even when the pH value is increased by alkaline metal ions dissolved from the nepheline mineral.

In case (2), the particles of a nepheline mineral are suitably coated with an inorganic coating by an alcoxide, prior to the mixing step according to the present invention. The inorganic coating on the nepheline mineral particles is suitably formed by using a solution containing a metal alcoxide, particularly a non-aqueous solution containing an unhydrolyzed metal alcoxide, preferably a stock solution of a metal alcoxide, so that polycondensation preferentially proceeds more on the surface of the nepheline mineral particles than between the molecules of the metal alcoxide.

In this case, it is advantageous that hydroxyl groups are preliminarily added on the surface of the nepheline mineral particles by exposure to water vapor or boiling in pure water, etc., to form, or increase the number of, bonding hands on the nepheline mineral particles for coupling with the metal alcoxide and the metalloxane polymer, thereby forming a dense coating. Preferably, hydrochloric acid is used as a nucleophilic reaction catalyst to facilitate graft polymerization of the metal alcoxide molecules on the surface of the nepheline mineral particles to form a dense coating of an inorganic oxide.

Figure 1:
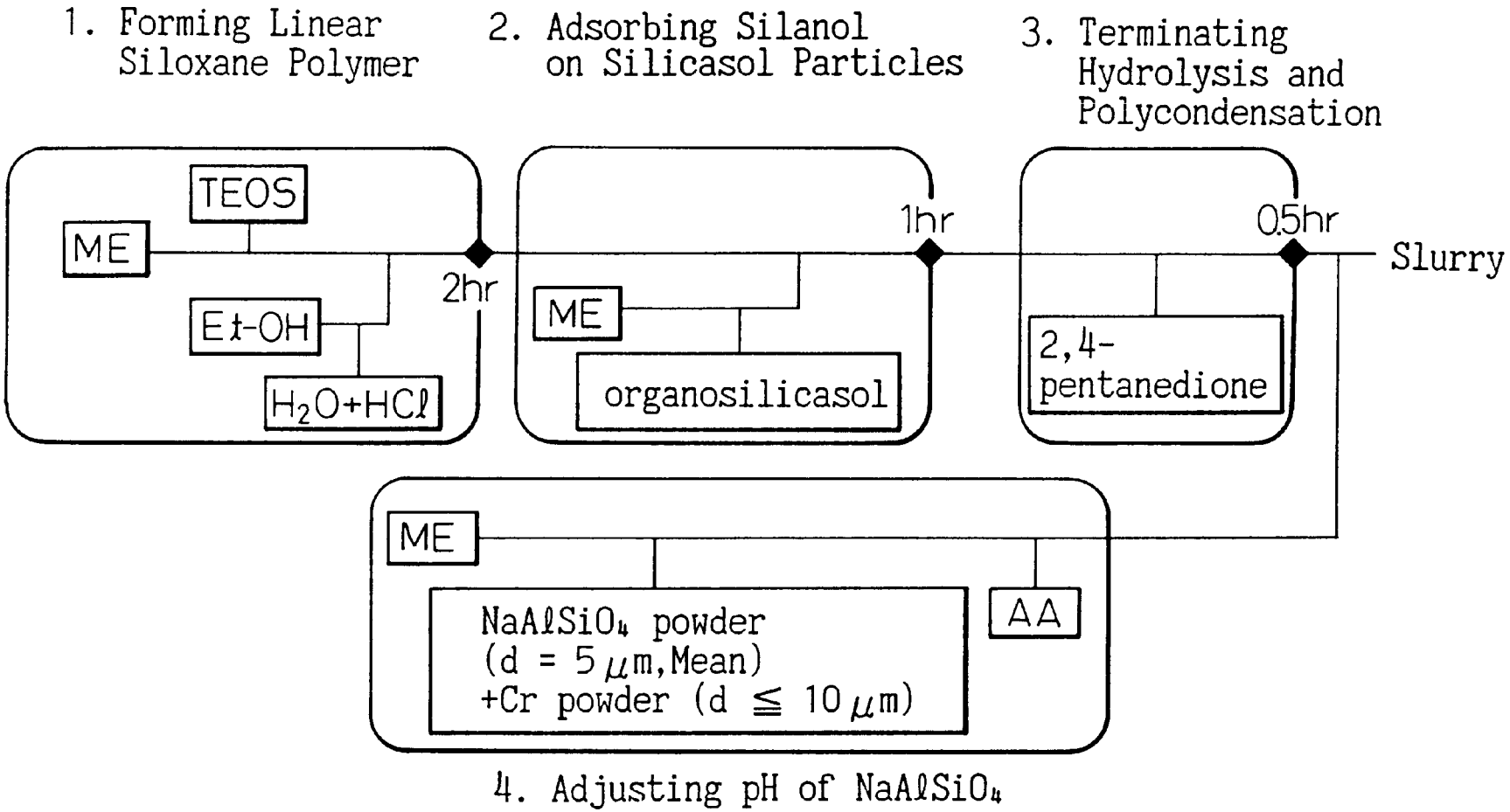
FIG. 1 is a flow chart showing a slurry preparation step of the present inventive process for forming a ceramic heat insulating layer having particles of a nepheline mineral as a main aggregate and a linear siloxane polymer as a main binder.

In the drawings, the abbreviations have the following meanings:

TEOS=tetraethoxysilane,

Et—OH=ethanol,

ME=2-methoxyethanol,

AA=anhydrous acetic acid,

NAS=nepheline mineral, and $NaAlSiO_4$=nepheline mineral.

DESCRIPTION OF THE PREFERRED EMBODIMENTS

EXAMPLE 1

According to the present invention, a bonding layer was formed on a base material and a ceramic heat insulating layer having a main binder of a linear siloxane polymer was formed on the bonding layer. A slurry was prepared by using the blend components summarized in Table 1 and in the process sequence shown in FIG. 1.

TABLE 1

| Phase | Blend component | Blend ratio M. R.(*1) | Blend ratio W. R.(*2) | |
|---|---|---|---|---|
| 1 | 2-methoxyethanol | 1 | | 1.5 |
| | tetraethoxysilane | 1 | | |
| | ethanol | 1 | | |
| | $H_2O$ | 2 | | |
| | HCl | 0.01 | | |
| 2 | 2-methoxyethanol | — | 1 | |
| | oraganosilicasol | 1/6(*3) | 1 | |
| 3 | 2,4-pentandione | 1/4 | — | |
| 4 | nepheline mineral particles | — | 1.5 | 3.5 |
| | chromium particles | — | 0.5 | |
| | 2-methoxyethanol | — | 1.2 | |
| | anhydrous acetic acid | — | 0.3 | |

Note
(*1)M. R.: molecular ratio
(*2)W. R.: weight ratio
(*3)the value reduced to the amount of $SiO_2$ (or $SiO_2$ equivalent)

A binder was prepared through the processing phases 1, 2 and 3, in which, in phase 1, tetraethoxysilane (TEOS) was dispersed in 2-methoxyethanol (ME) and agitated in the presence of $H_2O$ and HCl for 2 hours to cause hydrolysis and polycondensation (condensation polymerization) of the tetraethoxysilane (TEOS) to produce a linear siloxane polymer, which was then, in phase 2, adsorbed on the surface of silica particles originated from an organosilicasol in the form of a silanol (agitation at room temperature for 1 hour), and finally, in phase 3, the hydrolysis and polycondensation was terminated (agitation at room temperature for 0.5 hour).

An aggregate component was separately prepared in phase 4, in which a nepheline mineral powder (average particle size of 5 $\mu$m) and a Cr powder (average particle size of 10 $\mu$m or less) were dispersed in 2-methoxyethanol, which was then maintained acidic by adding therein anhydrous acetic acid (AA).

The binder prepared by phases 1 to 3 and the aggregate component prepared by phase 4 were mixed to form a slurry.

A bonding layer composed of a Fe—Ni alloy and a Cr oxide was formed on the surface of a cast iron base material and the slurry was then applied on the bonding layer, dried, and then fired in air at 850° C. for 5 hours to form a ceramic heat insulating layer having a thickness of 1 mm.

Figure 2:
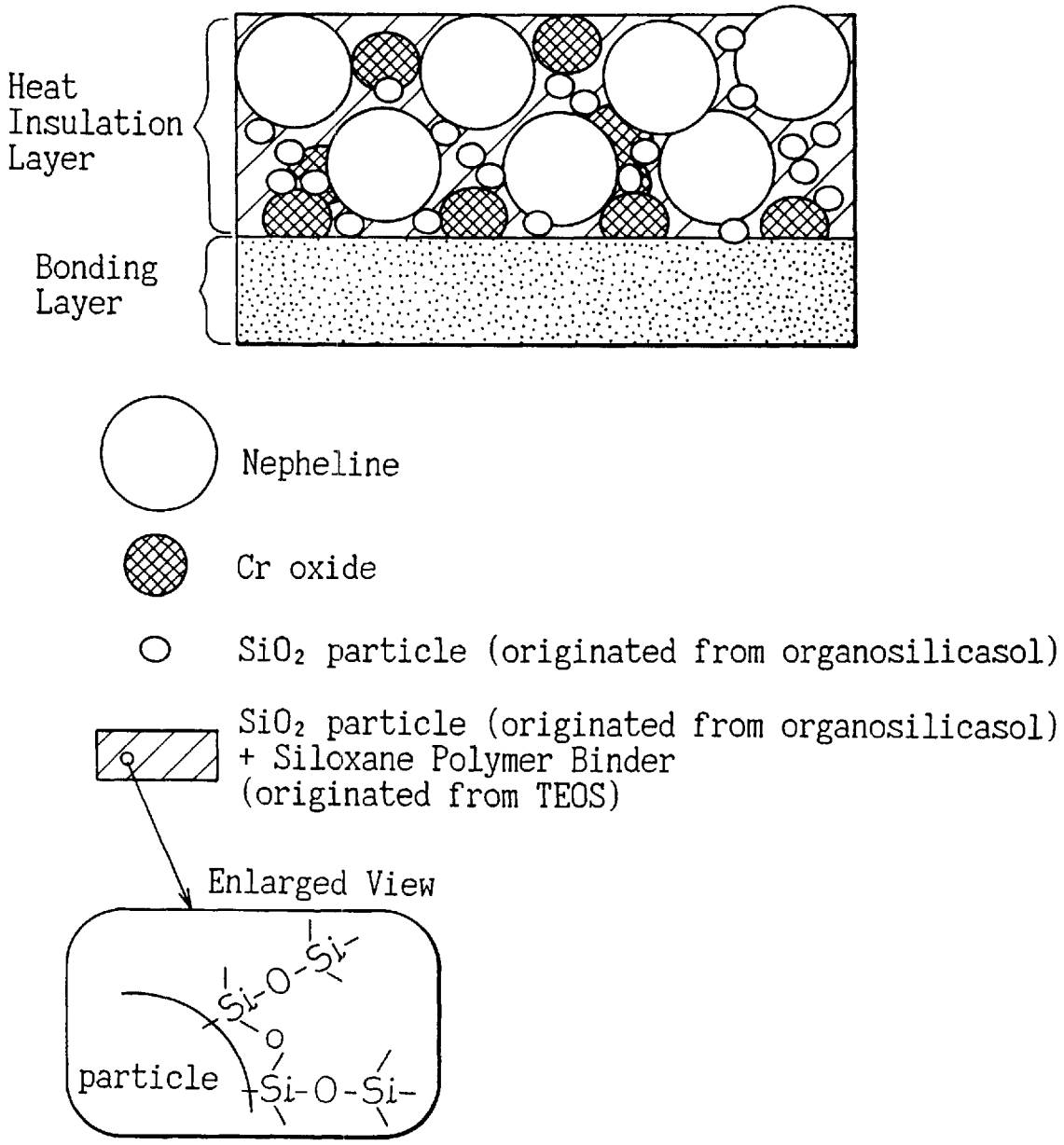
FIG. 2 is a schematic illustration of the cross-sectional structure of a nepheline mineral-based ceramic heat insulating layer formed from a slurry prepared by the step shown in FIG. 1.

FIG. 2 schematically illustrates the cross-sectional structure of the ceramic heat insulating layer observed by a scanning electron microscope and a transmission electron microscope. The ceramic heat insulating layer is formed on the bonding layer formed on the cast iron base material (not shown), and has aggregate particles composed of nepheline mineral particles (large blank circles in FIG. 2) and Cr oxide particles (cross-hatched circles) and a binder composed of silica particles (small blank circles) and a linear siloxane polymer (hatched portions between particles), the binder filling spaces between the aggregate particles and chemically bonding the aggregate particles to each other and to the bonding layer.

For comparison, the same bonding layer was formed on the same base material as the above, and on the bonding layer, a conventional iron-oxide-base ceramic heat insulating layer having $Fe_2O_3$ particles as an aggregate and aluminum phosphate as a binder and having the same thickness of 1 mm as the above was formed.

The bond strength and the heat insulation of these ceramic heat insulating layers were measured by the following methods, which were also used in the other examples which will be described later.

To evaluate the bond strength, a slice is cut from a sample having a ceramic heat insulating layer along the cross section in the direction of the thickness of the ceramic layer (the direction of the depth in the base material), the base material portion of the slice is held by a jig from both sides to only expose the ceramic layer portion of the slice from the jig, and a pressing force is applied to the exposed ceramic layer portion by another jig in the direction of the thickness of the slice (the direction along an interface between the base material and the heat insulating layer) until shear fracture occurs at the interface between the base material and the heat insulating layer, at which fracture a shear stress f is measured as the bond strength.

To evaluate the heat insulation, a heat insulating layer is formed on the inner wall of a hollow cylindrical base material, the atmosphere within the cylinder is held at 850° C. to simulate a heat flux in an exhaust manifold of an automobile engine, a pair of thermocouples are inserted in the cylinder from the circumferential surface in the direction toward the center thereof to measure a temperature at the interface between the base material and the heat insulating layer and a temperature at the free surface of the heat insulating layer, and the temperature difference $\Delta t$ between the two temperatures is used for the evaluation.

The measured results for the above two samples are summarized in Table 2.

TABLE 2

| Heat insulating layer | $\Delta t$ (° C.) | f (MPa) |
|---|---|---|
| Present invention | 60 | 60 |
| $Fe_2O_3$ - aluminum phosphate | 30 | 25 |

$\Delta t$: heat insulation, f: bond strength.

It can be seen from Table 2 that, in comparison with the conventional iron oxide-based ceramic heat insulating layer, the ceramic heat insulating layer according to the present invention not only has a significantly improved bond strength (invention: 60 MPa, conventional: 25 MPa) because the aggregate particles are chemically bonded to each other and to the base material (or to the bonding layer) by siloxane bonding and because the number of the bonding points is increased by the presence of a linear siloxane polymer, but also has a significantly improved heat insulation (invention: 60° C., conventional: 30° C.) because the aggregate particles are mainly composed of nepheline mineral particles.

EXAMPLE 2

In the process of forming a ceramic heat insulating layer in Example 1, nepheline mineral particles were subjected to different acid treatments prior to mixing with a binder for comparison.

Slurries were prepared with the same blend composition and the same process phases as in Example 1, except that, in phase 4, anhydrous acetic acid (AA) was (1) not used or was replaced by (2) HCl or (3) glacial acetic acid.

A bonding layer was formed on the base material in the same way as in Example 1, and the above-prepared three types of slurries were applied on the bonding layer, dried, and then fired under the same conditions as in Example 1 to form three types of ceramic heat insulating layers having a thickness of 1 mm.

Figure 3:
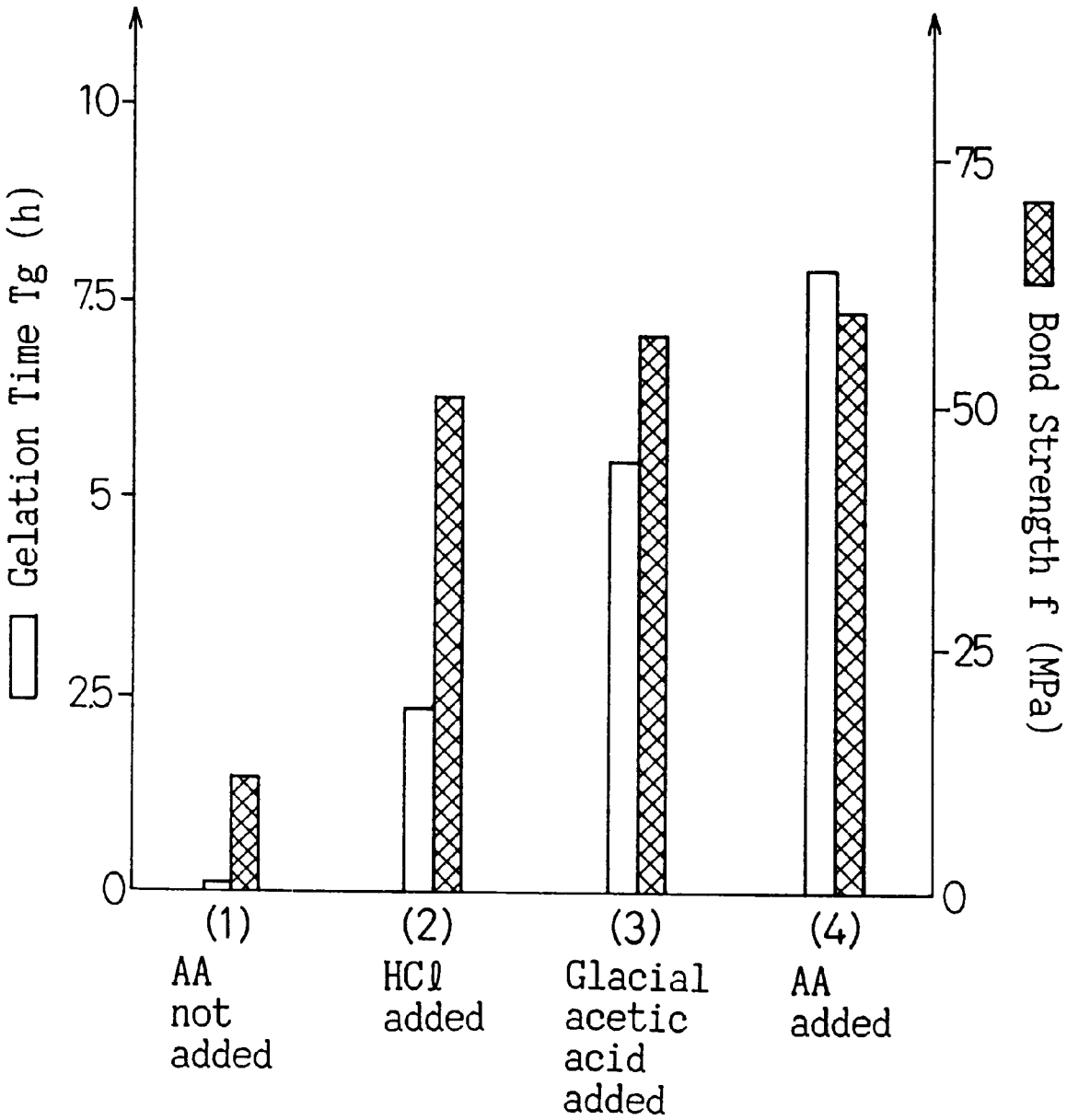
FIG. 3 is a graph showing the gelation time of a slurry prepared by mixing and the bond strength of ceramic heat insulating layer formed by firing, in relation to the acid treatments of the aggregate particles mainly composed of a nepheline mineral before mixing of the particles with a binder mainly composed of tetraethoxysilane (TEOS) in the slurry preparation step shown in FIG. 1.

FIG. 3 compares the gelation time of slurry and the bond strength of ceramic heat insulating layer between these three slurries and the slurry using anhydrous acetic acid used in Example 1.

It can be seen that the gelation time is significantly increased by acid-treating the nepheline mineral particles according to the present invention ((2), (3) and (4) in FIG. 3) in comparison with that achieved without acid-treating ((1) in FIG. 3), i.e., the gelation time is increased from several minutes of the non-treated case (1) to several hours of the acid-treated cases (2), (3) and (4), which means a sufficient stability of the slurry for commercial use.

The bond strength of ceramic heat insulating layer is also significantly more improved by acid treatment in (2), (3) and (4) than that achieved without acid treatment in (1). In particular, (3) and (4), in which organic acid treatment was used, provided the most improved strength because a reduction in the number of the bonding points due to retained inorganic acid was suppressed.

EXAMPLE 3

According to the present invention, a bonding layer was formed on a base material and a ceramic heat insulating layer having a main binder of a spherical siloxane polymer was formed on the bonding layer. A slurry was prepared with the blend composition shown in Table 3 and in the process sequence shown in FIG. 4.

TABLE 3

| | | Blend ratio | | |
|---|---|---|---|---|
| Phase | Blend component | M. R.(*1) | W. R.(*2) | |
| 1 | 2-methoxyethanol | 1 | — | 4 |
| | tetraethoxysilane | 1 | | |
| | $NH_3$ | 0.01 | | |
| | $H_2O$ | 2 | | |
| 2 | oraganosilicasol | 1(*3) | | |
| | $NH_3$ | depends on pH-adjust. | | |
| 3 | nepheline mineral particles | — | 4 | 5 |
| | chromium particles | — | 1 | |

Note
(*1)M. R.: molecular ratio
(*2)W. R.: weight ratio
(*3)$SiO_2$ equivalent

A binder was prepared by dispersing tetraethoxysilane (TEOS) in 2-methoxyethanol (ME), adding therein $NH_3$ to adjust the pH of the dispersed liquid to a value of greater than 7 and less than or equal to 8, and under the presence of $H_2O$, causing hydrolysis and polycondensation to produce a spherical siloxane polymer by agitating at room temperature for 1 hour. Organosilicasol, and then $NH_3$, were added in the dispersed liquid to adjust the pH of the liquid to a value of greater than 8 and less than 11.

In the above-prepared binder, nepheline mineral particles (average particle size of 5 $\mu$m) and a Cr powder (particle size of 10 $\mu$m or less) were added as aggregate particles to form a slurry.

A bonding layer was formed on a base material in the same way as in Example 1 and the above-formed slurry was applied on the bonding layer, dried, and then fired under the same conditions as in Example 1 to form a ceramic heat insulating layer having a thickness of 1 mm.

Figure 5:
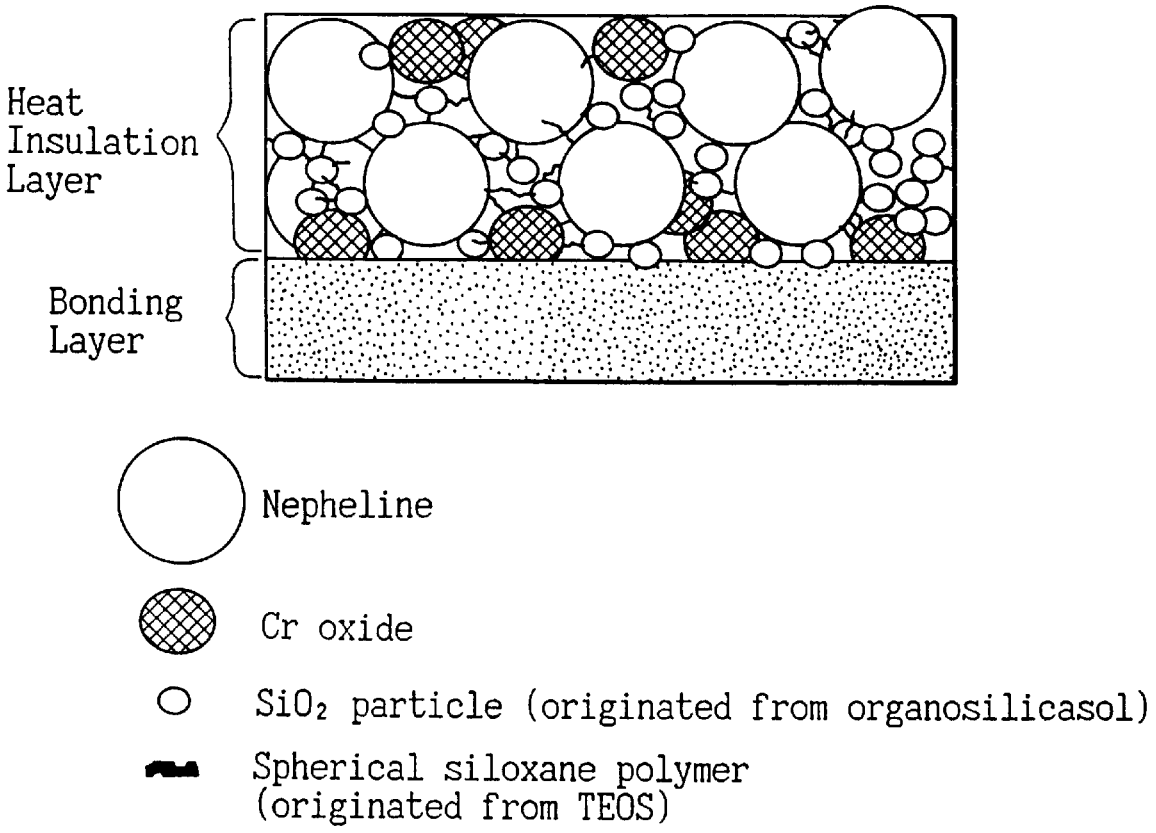
FIG. 5 is a schematic illustration of the cross-sectional structure of a nepheline mineral-based ceramic heat insulating layer formed from a slurry prepared by the step shown in FIG. 4.

FIG. 5 schematically illustrates the cross-sectional structure of the ceramic heat insulating layer observed by a scanning electron microscope and a transmission electron microscope. The ceramic heat insulating layer is formed on the bonding layer formed on the cast iron base material with (not shown), and has aggregate particles composed of nepheline mineral particles (large blank circles in FIG. 5) and Cr oxide particles (cross-hatched circles) and a binder composed of silica particles (small blank circles) and a spherical siloxane polymer (short segments between particles), the binder filling spaces between the aggregate particles and chemically bonding the aggregate particles to each other and to the bonding layer.

Figure 4:
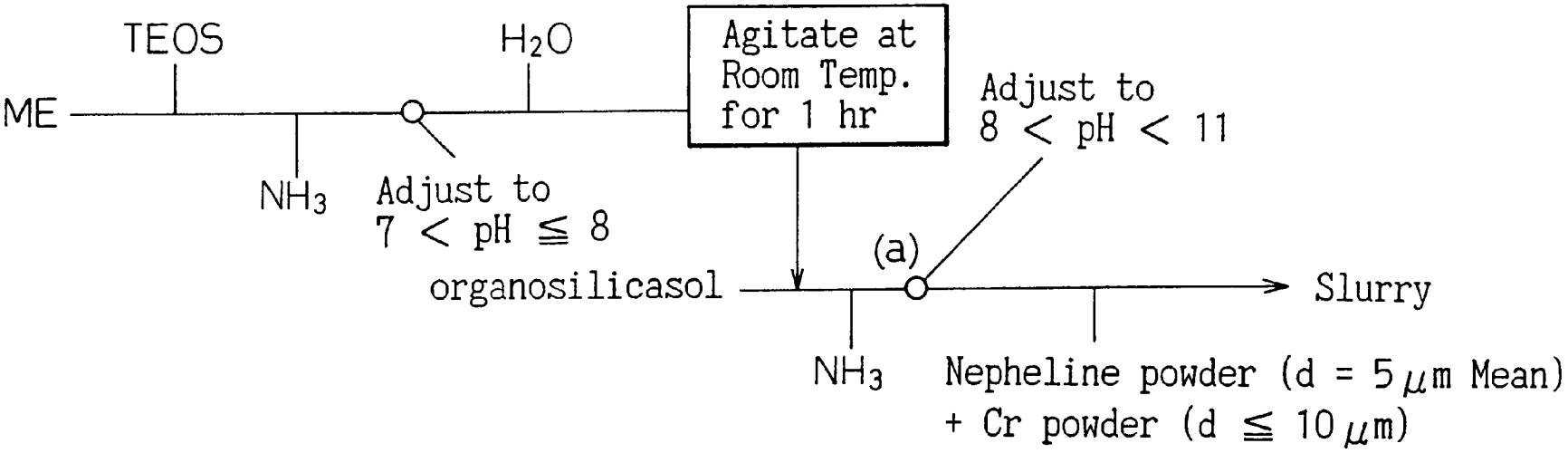
FIG. 4 is a flow chart showing a slurry preparation step of the present inventive process for forming a ceramic heat insulating layer having particles of a nepheline mineral as a main aggregate and a spherical siloxane polymer as a main binder.
Figure 6:
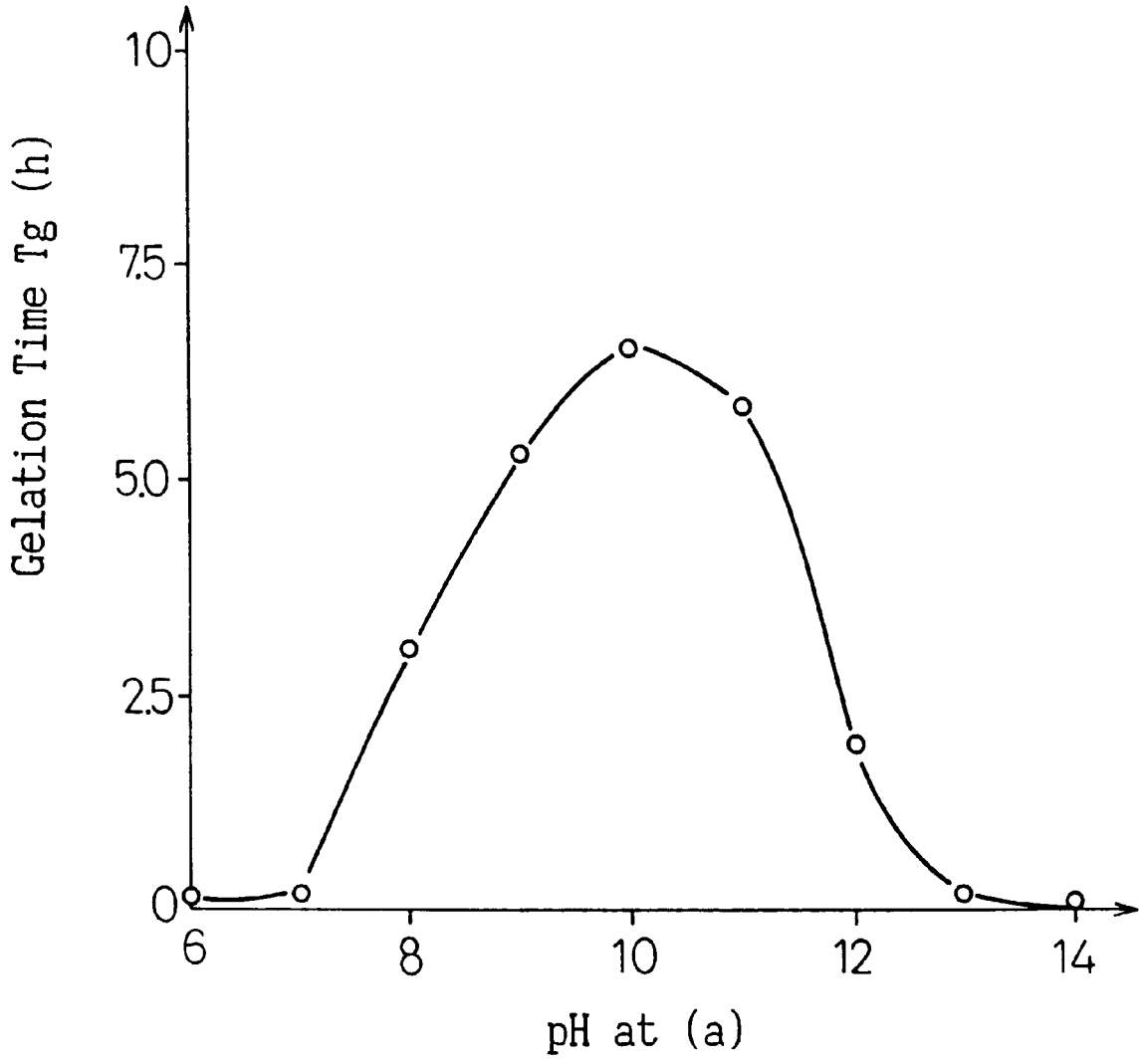
FIG. 6 is a graph showing the relationship between the gelation time of slurry prepared by mixing and the adjusted pH value of a dispersed liquid of a binder mainly composed of tetraethoxysilane (TEOS) in the slurry preparation step shown in FIG. 4.

In the process of preparing a slurry shown in FIG. 4, the pH of a dispersed liquid of a binder mainly composed of tetraethoxysilane (TEOS) was adjusted to different values prior to mixing with the aggregate mainly composed of nepheline mineral particles. FIG. 6 shows the relationship between the adjusted pH value and the gelation time of slurry.

As can be seen from FIG. 6, the gelation of slurry occurred in a few minutes when the binder dispersed liquid has a pH value of 7 or less before the mixing. This is because, when mixed with the aggregate, the pH value of the dispersed liquid is increased by alkaline metal ions dissolved from the nepheline mineral, and in the process of increase of the pH value, the surface potential of the dispersed binder and aggregate particles passes an isoelectric point to cause agglutination of the dispersed particles.

When the pH value of the dispersed liquid is preliminarily increased to 8 or more, the surface potential does not pass an isoelectric point if the pH is increased, and also, the resulting agglutination of the dispersed particles does not occur, so that the gelation of slurry can substantially be delayed, i.e., the gelation time can be increased to several hours or more.

The gelation time, however, reaches a peak at a pH value of 10 and is then decreased as the pH value is further increased. This is because, when the pH value exceeds 10, polycondensation of TEOS rapidly proceeds to accelerate the gelation of slurry.

It can be seen from FIG. 6 that the pH of the binder dispersed liquid is suitably adjusted to within the range of from 8 to 12 before the liquid is mixed with the aggregate particles.

Figure 7:
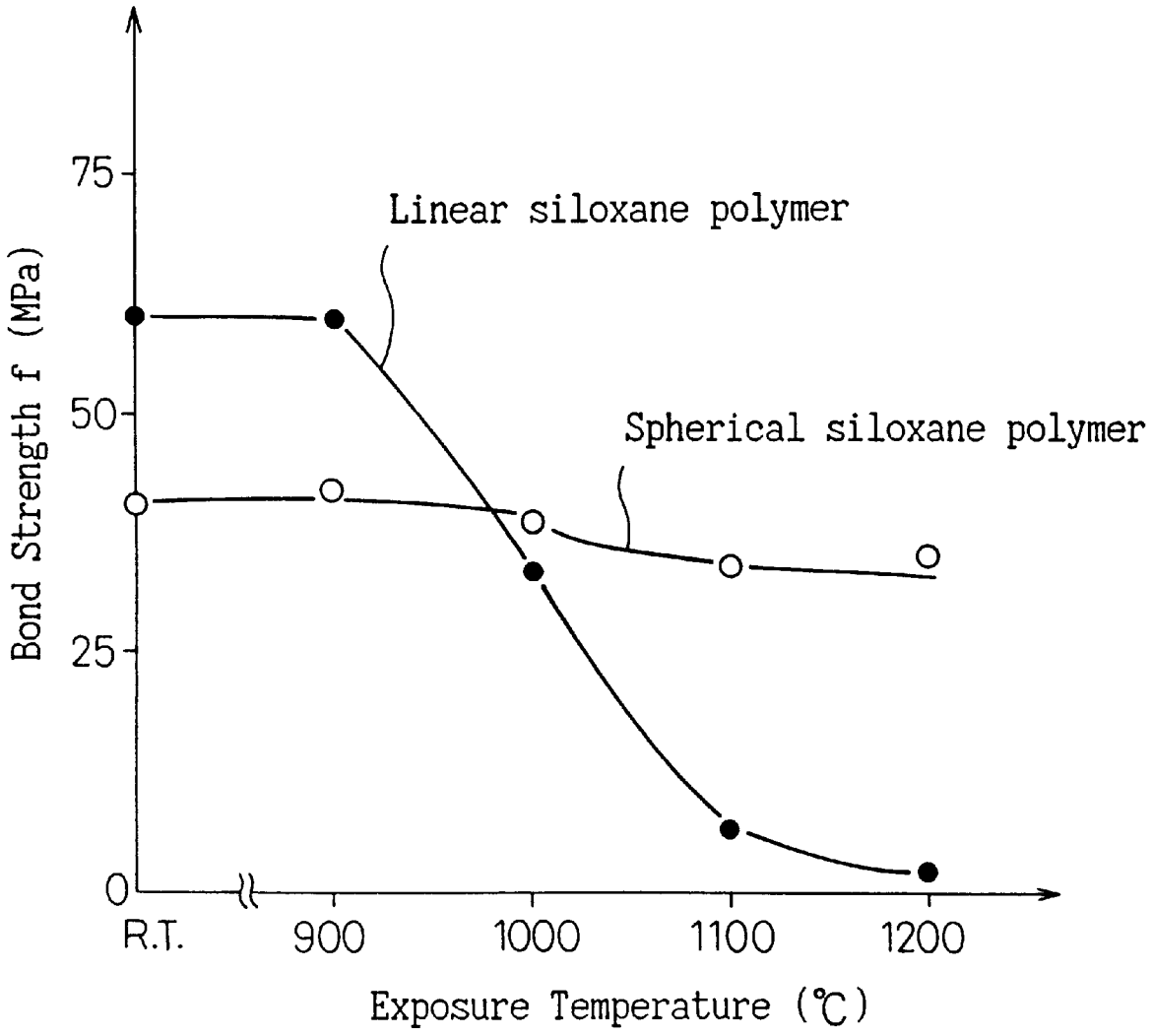
FIG. 7 is a graph showing the relationship between the exposure temperature and the bond strength for two types of the ceramic heat insulating layers formed by using spherical and linear siloxane polymers as a binder, respectively, according to the present invention.

FIG. 7 compares the bond strength at high temperatures between the ceramic heat insulating layer having a spherical siloxane polymer as a main binder produced in Example 3 and the ceramic heat insulating layer having a linear siloxane polymer as a main binder produced in Example 1.

The ceramic heat insulating layer of Example 1 containing a linear siloxane polymer and having a stiff structure exhibits a high bond strength corresponding to the stiff structure at temperatures up to 1000° C., but at higher temperatures, sintering of the nepheline mineral particles proceeds and the stiff structure only has a poor buffer effect against the sintering shrinkage causing easy occurrence of cracking and exfoliation to reduce the bond strength.

In contrast, the ceramic heat insulating layer of Example 3 containing a spherical siloxane polymer and having a less stiff or soft structure exhibits a relatively lower bond strength corresponding to the low stiffness of the structure at temperatures up to 1000° C., but at higher temperatures, the low stiffness advantageously provides a substantial buffer effect against the sintering shrinkage of nepheline mineral particles to ensure a high bond strength. As the result, when a spherical siloxane polymer is used as a binder, the bond strength can be maintained substantially constant at a high level over the whole testing temperatures ranging from room temperature to 1200° C.

EXAMPLE 4

According to the present invention, nepheline mineral particles were coated with a linear siloxane polymer and mixed with a binder to form a slurry, which was then used to form a ceramic heat insulating layer on a bonding layer formed on a base material in the same manner as in Example 1.

Figure 8:
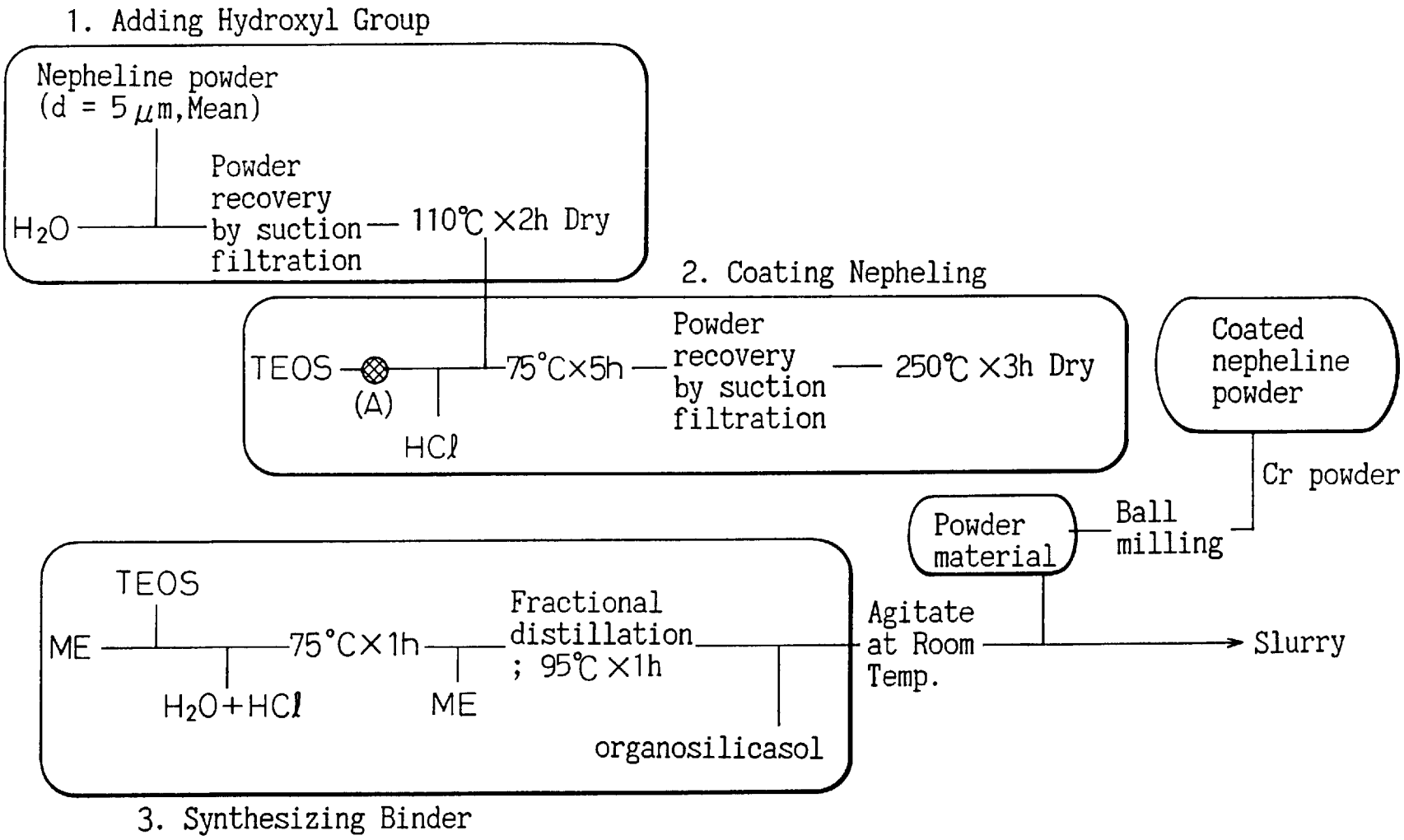
FIG. 8 is a flow chart of a slurry preparation step of the present inventive process, in which nepheline mineral particles are coated with a linear siloxane polymer and then mixed with a binder component.

A slurry was prepared with the blend composition shown in Table 4 and in the process sequence shown in FIG. 8.

TABLE 4

| Phase | Blend component | Blend ratio M. R.(*1) | Blend ratio W. R.(*2) | |
|---|---|---|---|---|
| 1 | nepneline mineral particles | — | 100 | 2 |
| | $H_2O$ | — | 800 | |
| | Cr particles | — | 25 | |
| 2 | tetraethoxysilane | 1 | 300 | |
| | ethanol | 0.1 | — | |
| | HCl | 0.01 | — | |
| 3 | ethanol | 50 | — | 2.5 |
| | tetraethoxysilane | 4 | — | |
| | $H_2O$ | 15.2 | — | |
| | HCl | 0.01 | — | |
| | 2-methoxyethanol | 1.4 | — | |
| | organosilicasol | 4(*3) | | |

Note
(*1)M. R.: molecular ratio
(*2)W. R.: weight ratio
(*3)$SiO_2$ equivalent

Figure 9:
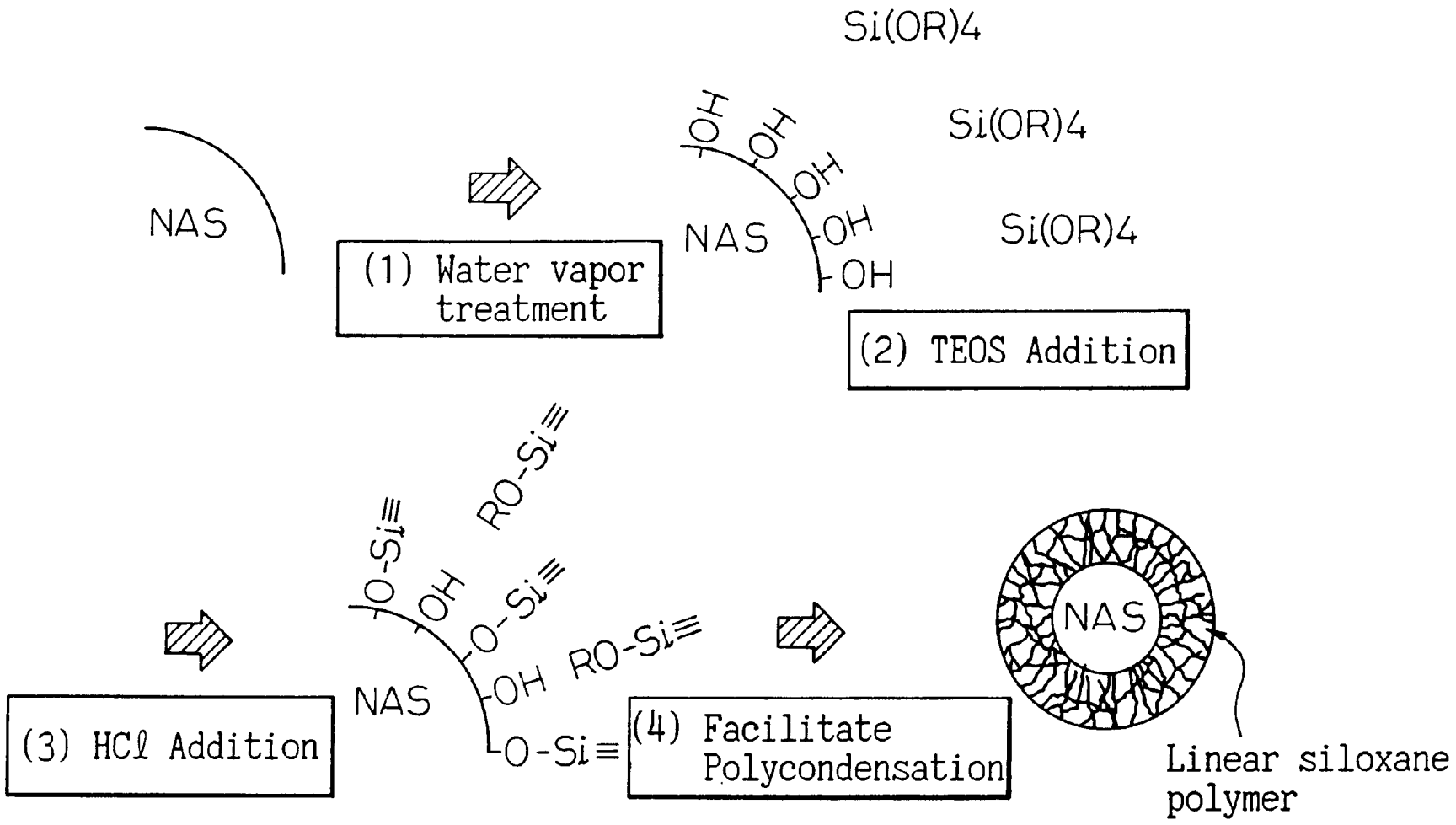
FIG. 9 schematically illustrates a processing sequence of the slurry preparation step shown in FIG. 8, in which hydroxylic groups are added on the surface of nepheline mineral particles and a linear siloxane polymer coating is then formed.

To prepare an aggregate, in phase 1, nepheline mineral particles having an average particle size of 5 $\mu$m were $H_2O$-treated by either exposing to water vapor or boiling in water to add hydroxyl groups to the surface of the particles, which were then recovered by suction filtration and the recovered powder was dried at 110° C. for 2 hours. Next, in phase 2, HCl as a nucleophilic reaction catalyst was added in tetraethoxysilane (TEOS) and the hydroxyl group-added nepheline mineral powder prepared in phase 1 was then added therein and the mixture was agitated at 75° C. for 5 hours, followed by suction filtration to recover a powder, which was then dried at 250° C. for 3 hours. This yielded a nepheline mineral powder with the particles coated with a linear siloxane polymer. FIG. 9 schematically illustrates the reaction process through phases 1 and 2.

In phase 3, a binder was prepared by adding tetraethoxysilane (TEOS) in a dispersing medium of 2-methoxyethanol (ME), adding $H_2O$ and HCl, agitating the mixture at 75° C. for 1 hour, adding the rest of 1-methoxyethanol, fractionally distilling the mixture at 95° C. for 1 hour, adding organosilicasol, and agitating at room temperature.

The nepheline mineral aggregate prepared by phases 1 and 2 and the binder prepared by phase 3 were mixed to form a slurry.

A bonding layer was formed on a base material as in Example 1 and the slurry was applied on the bonding layer, dried, and then fired under the same conditions as in Example 1 to form a ceramic heat insulating layer having a thickness of 1 mm.

Figure 10:
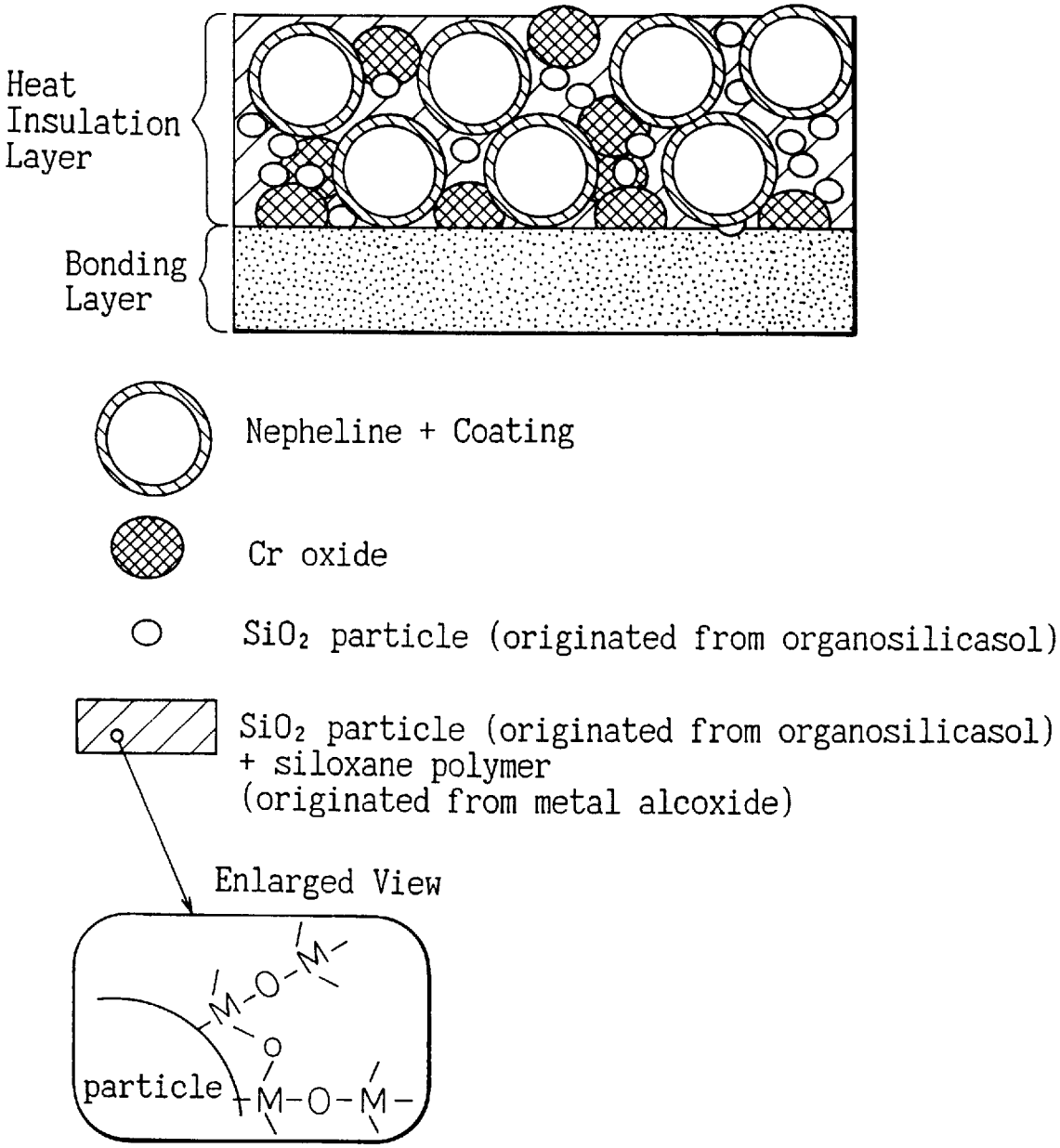
FIG. 10 is a schematic illustration of the cross-sectional structure of a nepheline mineral-based ceramic heat insulating layer formed from a slurry prepared by the step shown in FIG. 8.

FIG. 10 schematically illustrates the cross-sectional structure of the ceramic heat insulating layer observed by a scanning electron microscope and a transmission electron microscope. The ceramic heat insulating layer is formed on the cast iron base material with the bonding layer interposed therebetween, and has an aggregate composed of nepheline mineral particles (large blank circles in FIG. 10) and Cr oxide particles (cross-hatched) and a binder composed of silica particles (small blank circles) and a linear siloxane polymer (hatched portions between particles), the binder chemically bonding the particles of the aggregate to each other and to the bonding layer. The nepheline mineral particles shown by a large blank circle are coated with the linear siloxane polymer shown by a hatched case surrounding the large blank circle.

Table 5 shows the heat insulation (Δt) and the bond strength (f) of the ceramic heat insulating layer of Example 4 in comparison with those of the conventional iron oxide-based ceramic heat insulating layer.

TABLE 5

| Heat insulating layer | Δt (° C.) | f (MPa) |
|---|---|---|
| Present invention | 70 | 80 |
| $Fe_2O_3$ - aluminum phosphate | 30 | 25 |

Δt: heat insulation, f: bond strength.

The linear siloxane polymer present as a coating on the nepheline mineral particles, as well as that present as a binder, also provides bonding hands between the aggregate particles and the base material (or the bonding layer on the base material) to provide a further improved heat insulation and bond strength in comparison with those obtained in Example 1.

EXAMPLE 5

To demonstrate the advantageous effect of the linear siloxane polymer coating on the nepheline mineral particles according to the present invention, the following comparative experiments were conducted.

Figure 11:
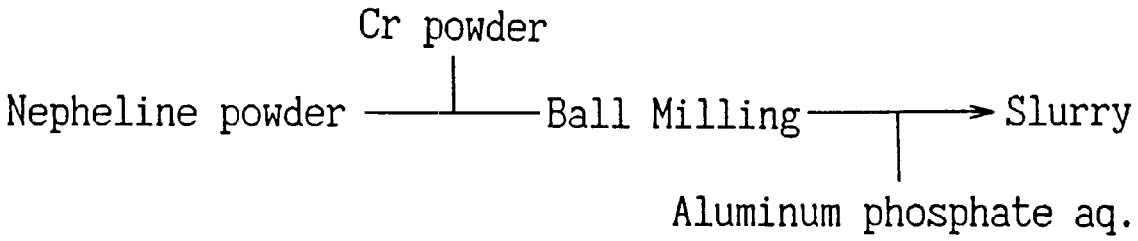
FIG. 11 is a flow chart of a slurry preparation step in which the nepheline mineral particles coated with a linear siloxane polymer in the slurry preparation step shown in FIG. 8 are mixed with a conventional aluminum phosphate binder to form a slurry, to demonstrate the advantageous effect of coating the nepheline mineral particles.

An aggregate was prepared in the same manner as in Example 4, i.e., with the blend composition shown in Table 4 and through phases 1 and 2 shown in FIG. 8 to coat the nepheline mineral particles with a linear siloxane polymer. A conventional aluminum phosphate-based binder was prepared with the blend composition shown in Table 6 and a slurry was prepared by the process sequence shown in FIG. 11.

TABLE 6

| | Blend component | Weight ratio | |
|---|---|---|---|
| Powder | nepheline mineral particles | 4 | 2 |
| | Cr particles | 1 | |
| Dispersing medium containing binder | aqueous solution of aluminum phosphate (solid conc. = 30%) | — | |

A bonding layer was formed on a base material in the same manner as in Example 1 and the slurry was applied on the bonding layer, dried and then fired under the same conditions as in Example 1 to form a ceramic heat insulating layer having a thickness of 1 mm.

Figure 12:
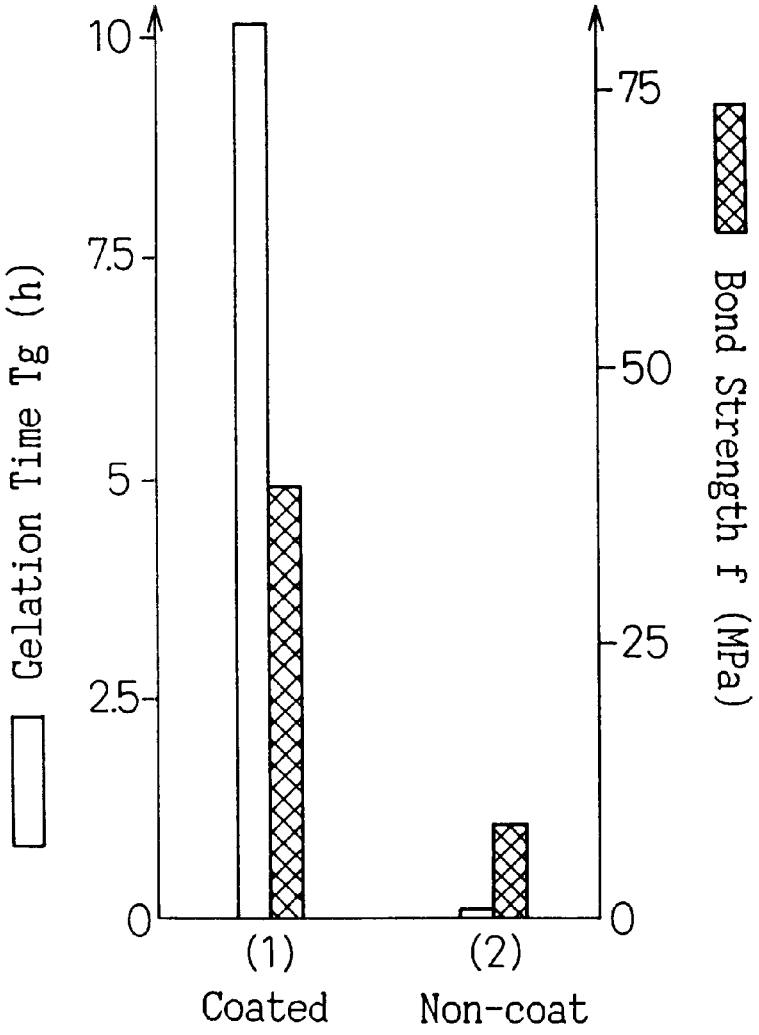
FIG. 12 is a graph showing the gelation time of a slurry prepared by the step shown in FIG. 11 and the bond strength of a nepheline mineral-based ceramic heat insulating layer formed from the slurry, comparing two cases in which nepheline mineral particles are coated and non-coated, respectively.

FIG. 12 compares the gelation time of a slurry prepared by mixing the aggregate and the binder and the bond strength of a ceramic heat insulating layer formed by applying the slurry, drying and firing, between the cases (1) having and (2) not having the coating on nepheline mineral particles, respectively.

In the non-coat case (2), alkaline metal ions dissolved from the nepheline mineral reacted with the phosphoric acid of the binder to form an insoluble salt and causes rapid gelation or setting of the slurry. Moreover, the formation of the insoluble salt only provided a low polymerization degree of aluminum phosphate and the bare nepheline mineral particles only had a small number of bonding bands and failed to provide a high bond strength as achieved in case (1) in which the nepheline mineral particles were coated.

EXAMPLE 6

Comparative experiments were conducted by varying the conditions for coating nepheline mineral particles in phases 1 and 2 shown in FIG. 8 used in Example 5.

In Comparative Examples 1 and 2, a ceramic heat insulating layer was formed under the same conditions as in Example 5, except that, at stage (A) in phase 2 shown in FIG. 8, either (1) the same molar amount or (2) double the molar amount of $H_2O$ was added to the tetraethoxysilane (TEOS).

In Comparative Example 3, a ceramic heat insulating layer was formed under the same conditions as in Example 5, except that hydroxyl groups were not added in phase 1 shown in FIG. 8.

In Comparative Example 4, a ceramic heat insulating layer was formed under the same conditions as in Example 5, except that HCl was not added in the phase 2 shown in FIG. 8.

Figure 13:
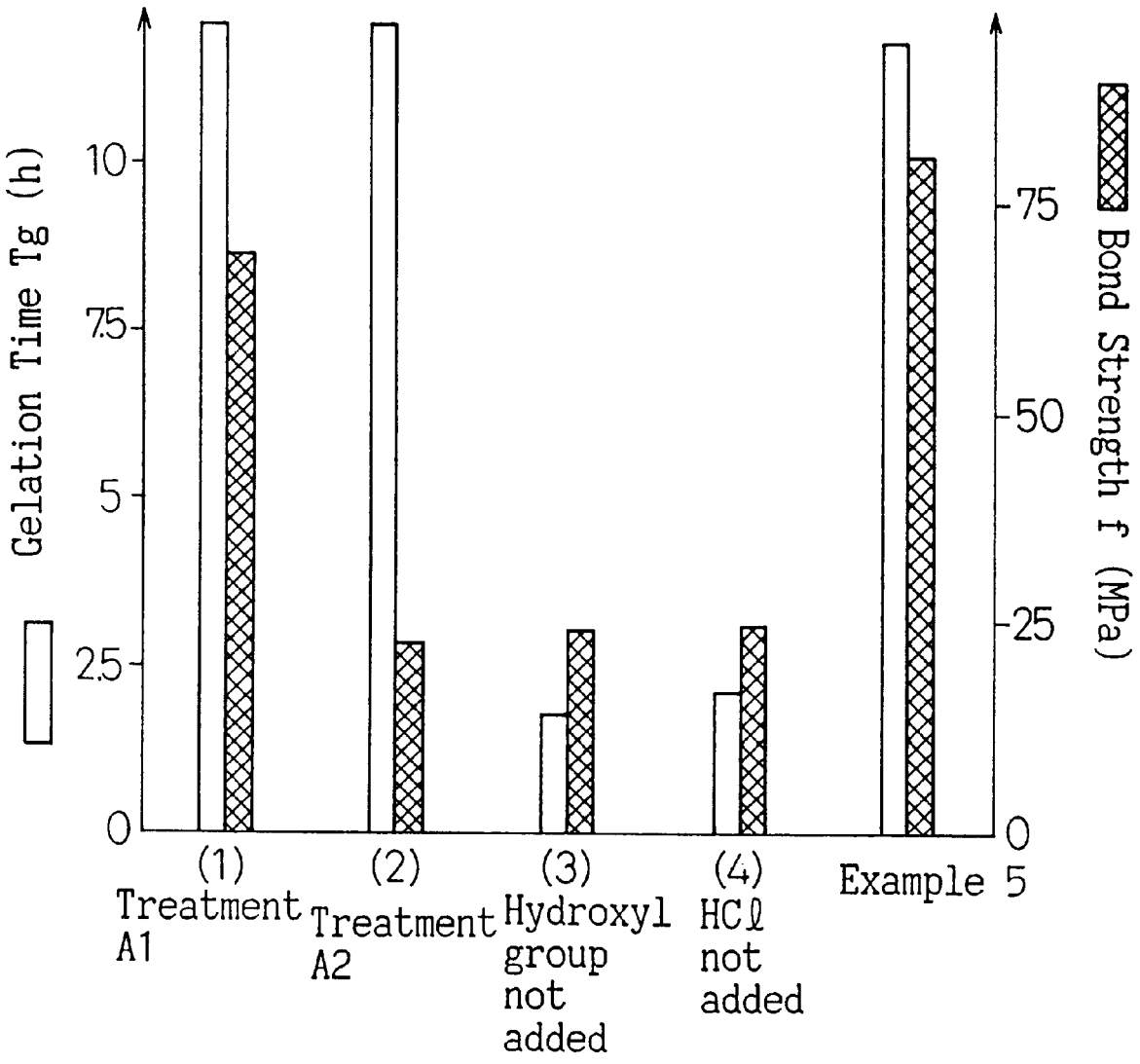
FIG. 13 is a graph showing the gelation time of slurry and the bond strength of a ceramic heat insulating layer, in relation to the conditions for coating the nepheline mineral particles.

FIG. 13 compares the gelation time of slurry and the bond strength of ceramic heat insulating layer, between Comparative Examples 1 to 4 and Example 5.

In Comparative Examples 1 and 2, the addition of $H_2O$ to TEOS for use in phase 2 promoted formation of the coating to provide a small increase in the gelation time of slurry relative to Example 5. On the other hand, polymerization between alkoxide molecules was promoted during the formation of the coating causing bonding between the powder particles to increase the aggregate particle size and the packing density of the aggregate particles was thus reduced to lessen the number of the sites for bonding between particles, with the result that the ceramic heat insulating layer had a significantly reduced bond strength. This tendency is particularly remarkable in Comparative Example 2 in which a relatively greater amount of $H_2O$ was added in TEOS.

In Comparative Example 3, because hydroxyl groups were not added to the surface of nepheline mineral particles, a linear siloxane polymer coating formed on the particles was not dense and failed to prevent dissolution of alkaline metal ions, with the result that the gelation of the slurry occurred in a short time. Thus, the slurry was not suitably prepared and the ceramic heat insulating layer had a low bond strength.

In Comparative Example 4, because HCl was not present as a nucleophilic reaction catalyst, polycondensation did not preferentially occur on the surface of nepheline mineral particles and a linear siloxane polymer coating formed on the particles was not dense and failed to prevent dissolution of alkaline metal ions, with the result that the gelation of slurry occurred in a short time. Thus, the slurry was not suitably prepared and the ceramic heat insulating layer had a low bond strength.

In the preceding Examples 1 to 6, a ceramic heat insulating layer was formed on a bonding layer on a base material, the bonding layer being composed of a Fe—Ni alloy and Cr oxides.

In the following Examples 7 and 8, a ceramic heat insulating layer will be formed directly on a base material having no bonding layer thereon.

EXAMPLE 7

According to the present invention, a ceramic heat insulating layer was formed directly on a base material having no bonding layer thereon, by applying a slurry directly on the base material, drying, and then firing in an inert atmosphere.

As in Example 4, a linear siloxane polymer coating was formed on the surface of nepheline mineral particles, which was then mixed with a binder to form a slurry.

The slurry had the blend composition shown in Table 7, which is the same as that shown in Table 4 used in Example 4, except that no Cr powder was added. The slurry was prepared in the same process sequence as shown in FIG. 8 used in Example 4.

TABLE 7

| | | Blend ratio | | |
|---|---|---|---|---|
| Phase | Blend component | M. R.(*1) | W. R.(*2) | |
| 1 | nepheline mineral particles | — | 100 | 2 |
| | $H_2O$ | — | 800 | |
| 2 | tetraethoxysiiane | 1 | 300 | |
| | ethanol | 0.1 | — | |
| | HCl | 0.01 | — | |
| 3 | ethanol | 50 | — | 2.5 |
| | tetraethoxysilane | 4 | — | |
| | $H_2O$ | 15.2 | — | |
| | HCl | 0.01 | — | |
| | 2-methoxyethanol | 1.4 | — | |
| | organosilicasol | 4(*3) | — | |

Note
(*1)M. R.: molecular ratio
(*2)W. R.: weight ratio
(*3)$SiO_2$ equivalent

The slurry was applied on a cast iron base material to a thickness of 1 mm, dried, and then fired in an Ar gas atmosphere at 850° C. for 5 hours to form a ceramic heat insulating layer (Sample 1).

Figure 14:
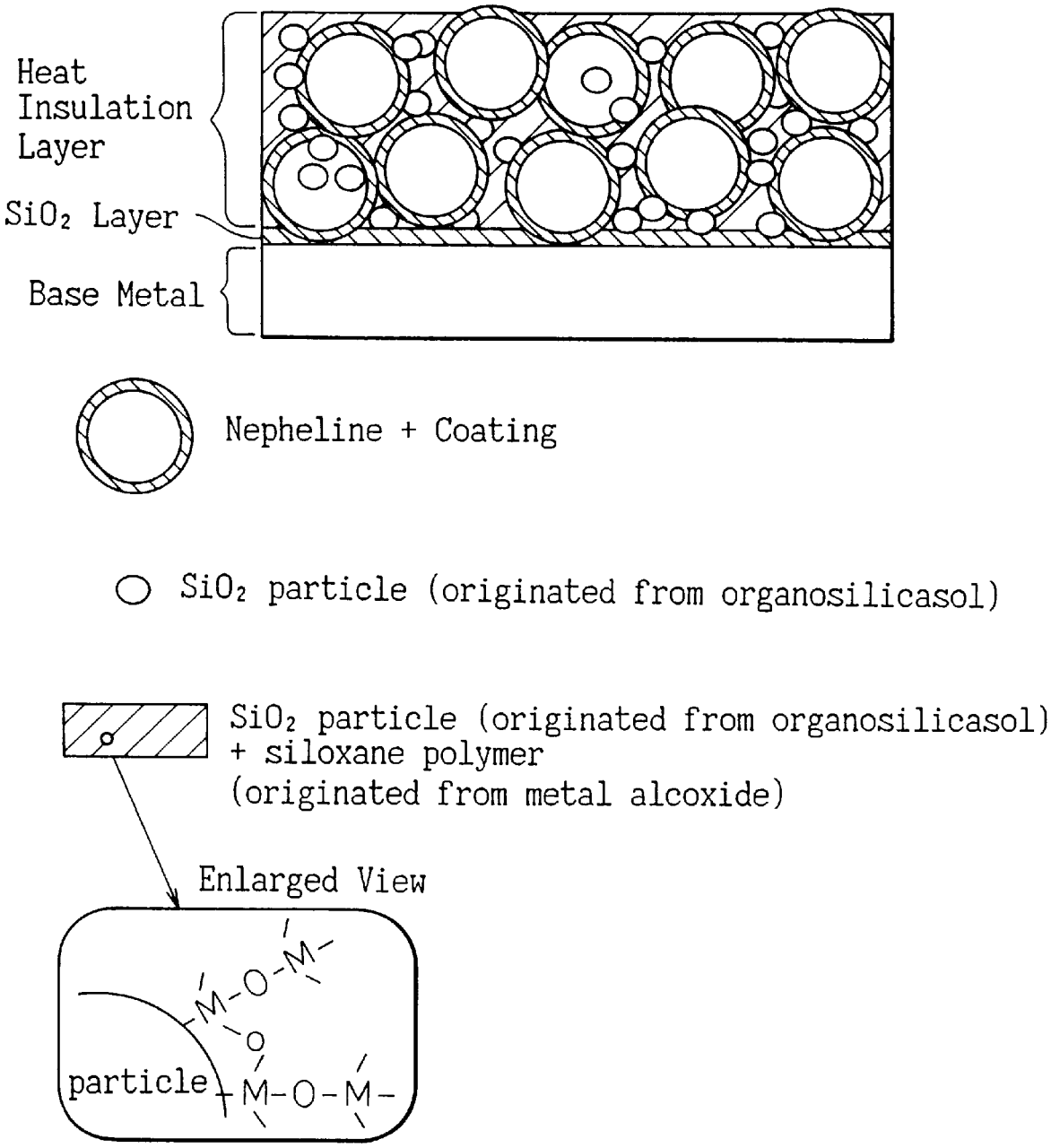
FIG. 14 is a schematic illustration of the cross-sectional structure of a nepheline mineral-based ceramic heat insulating layer not containing Cr oxides, which layer is formed from a slurry prepared by the same step as shown in FIG. 8 except that no Cr powder is added.

FIG. 14 schematically illustrates the cross-sectional structure of the ceramic heat insulating layer observed by a scanning electron microscope and a transmission electron microscope. The ceramic heat insulating layer has a dense $SiO_2$ layer formed on the cast iron base material and has an aggregate composed of nepheline mineral particles (large blank circles in FIG. 14) and a binder composed of silica particles (small blank circles) and a linear siloxane polymer (hatched portions between particles), the binder filling spaces between particles and chemically bonding the particles of the aggregate to each other and to the $SiO_2$ layer on the base material. The nepheline mineral particles shown by a large blank circle are coated with the linear siloxane polymer shown by a hatched case surrounding the large blank circle.

For comparison, a ceramic heat insulating layer was formed by using the same slurry and firing in air (Sample 2), and also, ceramic heat insulating layers were formed by using the same slurry except that a Cr powder having an average particle size of 10 $\mu$m was added in an amount of 20 wt % based on the nepheline mineral powder and by firing in an Ar gas atmosphere (Sample 3) and in air (Sample 4), respectively.

The bond strength f and the heat insulation $\Delta t$ were measured for Samples 1 to 4, in which a ceramic heat insulating layer was formed directly on a base material having no bonding layer. The measured results are summarized in Table 8.

TABLE 8

| No. | Cr | Firing atmosphere | f (MPa) | Δt (° C.) |
|---|---|---|---|---|
| 1 | None | Ar | 50 | 85 |
| 2 | | air | 5 | — |
| 3 | Added | Ar | 61 | 60 |
| 4 | | air | 11 | — |

Δt: heat insulation, f: bond strength.

In Sample 1, prepared by using no Cr powder and firing in an Ar atmosphere, a dense $SiO_2$ layer was formed by chemical bonding of siloxane polymer on the base material to prevent exfoliation due to oxidation of the base material and the $SiO_2$ layer is strongly bonded with the aggregate mainly by chemical bonding, thereby providing a high bond strength.

The ceramic heat insulating layer of Sample 1 also had an improved heat insulation in both heat conduction and heat radiation because it contained no Cr oxides having a heat conductivity about 150 times that of a nepheline mineral and because it exhibited a white color of the nepheline mineral present as a main aggregate due to the absence of Cr oxides exhibiting a green color.

In Sample 2 prepared by using no Cr powder and firing in air, no $SiO_2$ layer was formed on the base material and oxidation of the base material occurred, with the result that no substantial formation of a ceramic heat insulating layer was achieved.

In Sample 3 prepared by adding a Cr powder and firing in an Ar gas atmosphere, a ceramic heat insulating layer was formed which was strongly bonded to the base material through Cr oxides produced during the firing to provide a high bond strength although the heat insulation was lower than Sample 1 in both heat conduction and heat radiation because of inclusion of Cr oxides.

In Sample 4 prepared by adding a Cr powder and firing in air, oxidation of the base material occurred as in Sample 2 and no substantial formation of a ceramic heat insulating layer was achieved.

EXAMPLE 8

A first slurry containing no Cr powder as in Example 7 was applied on a base material having no bonding layer thereon, dried, and then fired in an inert atmosphere to form a porous ceramic heat insulating layer, and thereafter, a second slurry having a Cr powder as an aggregate was applied on the porous layer, dried, and then fired to form a sealing layer composed of Cr oxides in the surface region of the porous ceramic layer.

The first slurry was prepared in basically the same process sequence as in Example 4, i.e., through phases 1, 2 and 3, except that no Cr powder was added in phase 1 for preparing an aggregate and that an increased amount of a dispersing medium for diluting a binder was used in phase 3 for preparing a binder.

The blend composition of the first slurry was varied in the following compositional parameters C1, C2 and C3 by varying the weight ratios Wp, W1, W2 and W3 shown in Table 9.

C1=concentration of metal alcoxide (TEOS in this example) =W1/(W2+W3),

C2=concentration of powder (nepheline mineral powder) =Vp/Vt, and

C3=concentration of solid component of binder =(a1W1+a2W2)/(W1+W2+W3), wherein W1=mass of metal alcoxide binder, W2=mass of organosilicasol binder, W3=mass of diluting and dispersing medium, Vp=volume of powder material (calculated from Wp), Vt=volume of slurry, a1=concentration of solid component of metal alcoxide binder, and a2=concentration of solid component of organosilicasol binder.

TABLE 9

| Phase | Blend component | Blend ratio M. R.(*1) | Blend ratio W. R.(*2) | |
|---|---|---|---|---|
| 1 | nepheline mineral particles | — | 100 | Wp |
| | $H_2O$ | — | 800 | |
| 2 | tetraethoxysilane | 1 | 300 | |
| | ethanol | 0.1 | — | |
| | HCl | 0.01 | — | |
| 3 Binder 1 | ethanol | 50 | W1 | |
| | tetraethoxysilane | 4 | | |
| | $H_2O$ | 15.2 | | |
| | HCl | 0.01 | | |
| | 2-methoxyethanol | 1.4 | | |
| Binder 2 | organosilicasol | — | W2 | |
| 4 Solvent for diluting binder | 2-methoxyethanol | — | W3 | |

Note
(*1)M. R.: molecular ratio
(*2)W. R.: weight ratio

The second slurry was prepared with the blend composition shown in Table 10.

TABLE 10

| Blend component | Weight ratio | Volume ratio |
|---|---|---|
| Cr powder (d = 10 μm, average) | — | 17.5 |
| Binder 1 | 1 | 82.5 |
| Binder 2 | 1 | |
| Solvent for diluting binder (2-methoxyethano) | 8.2 | |

The first slurry was first applied on a cast iron base material to a thickness of 1 mm, dried, and then fired in an Ar atmosphere at 850° C. for 5 hours to form a porous ceramic heat insulating layer. The second slurry was then applied on the porous ceramic layer, dried, and then fired in air at 850° C. for 5 hours to form a sealing layer composed of Cr oxides in the surface region of the porous ceramic heat insulating layer.

Figure 15:
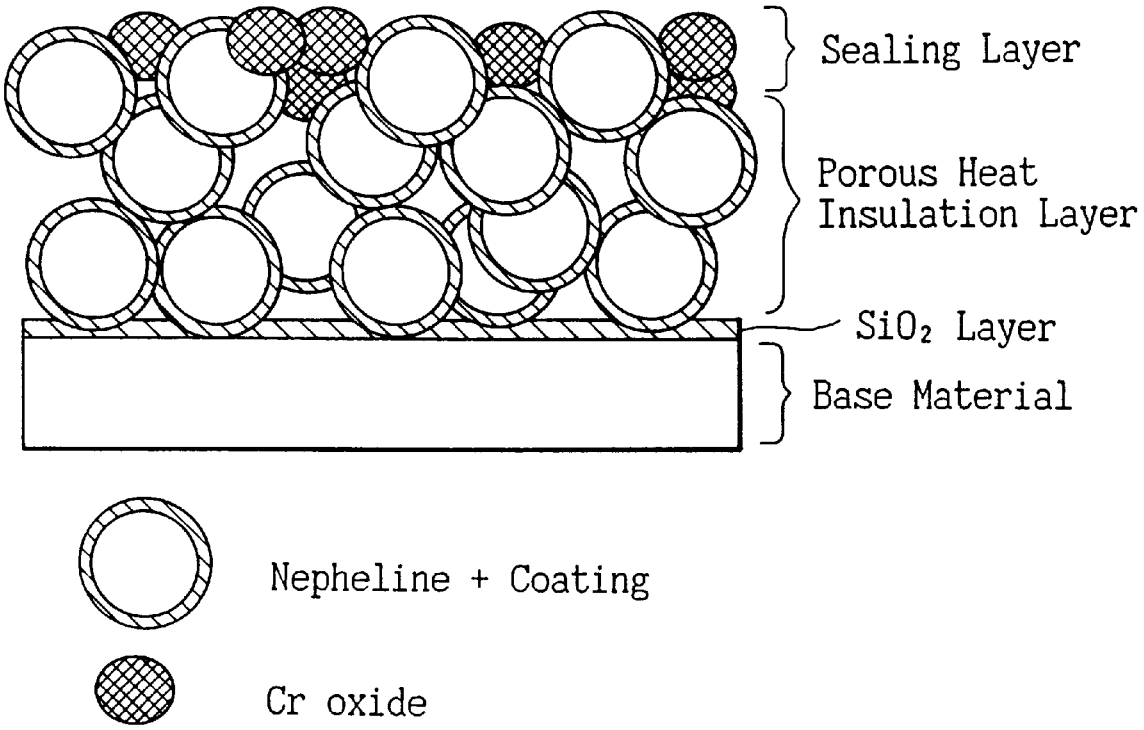
FIG. 15 is a schematic illustration of the cross-sectional structure of a porous nepheline mineral-based ceramic heat insulating layer not containing Cr oxides and having a sealing layer of Cr oxides in the surface region, which layer is formed from a slurry prepared by the same step as shown in FIG. 8 except that no Cr powder is added and that the mixing proportion is varied.

FIG. 15 schematically illustrates the cross-sectional structure of the ceramic heat insulating layer observed by a scanning electron microscope and a transmission electron microscope. The ceramic heat insulating layer has a dense $SiO_2$ layer formed by a siloxane polymer on the cast iron base material and has an aggregate composed of nepheline mineral particles (large blank circles in FIG. 15) and a binder composed of silica particles (not shown) and a linear siloxane polymer (not shown), the binder intervening between particles leaving voids and chemically bonding the particles of the aggregate to each other and to the $SiO_2$ layer, and further, in the surface region, a sealing layer composed of Cr oxides (cross-hatched) filling spaces between the aggregate particles of a nepheline mineral. The nepheline mineral particles shown by a large blank circle are coated with the linear siloxane polymer shown by a hatched case surrounding the large blank circle.

Figure 16:
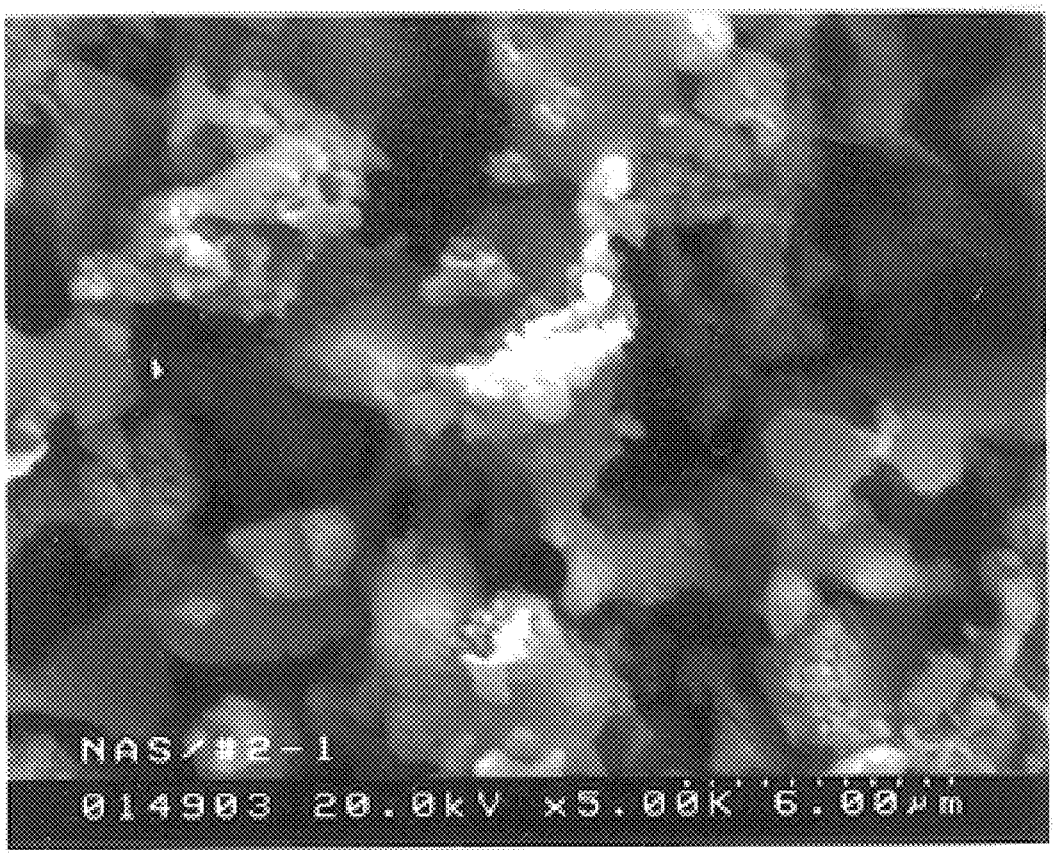
FIG. 16 is a scanning electron micrograph of a fracture surface of the porous nepheline mineral-based ceramic heat insulating layer schematically illustrated in FIG. 15.

FIG. 16 shows a scanning electron microscope image of the thus-formed ceramic heat insulating layer, in which the bright portions are aggregate particles and the dark portions are voids between the aggregate particles.

The heat insulation and the bond strength were measured for ceramic heat insulating layers formed with different values of the compositional parameters C1 of 20 to 80%, C2 of 5 to 30%, and C3 of 5 to 25%, which were varied by varying the weight ratios Wp, W1, W2 and W3.

Figure 17:
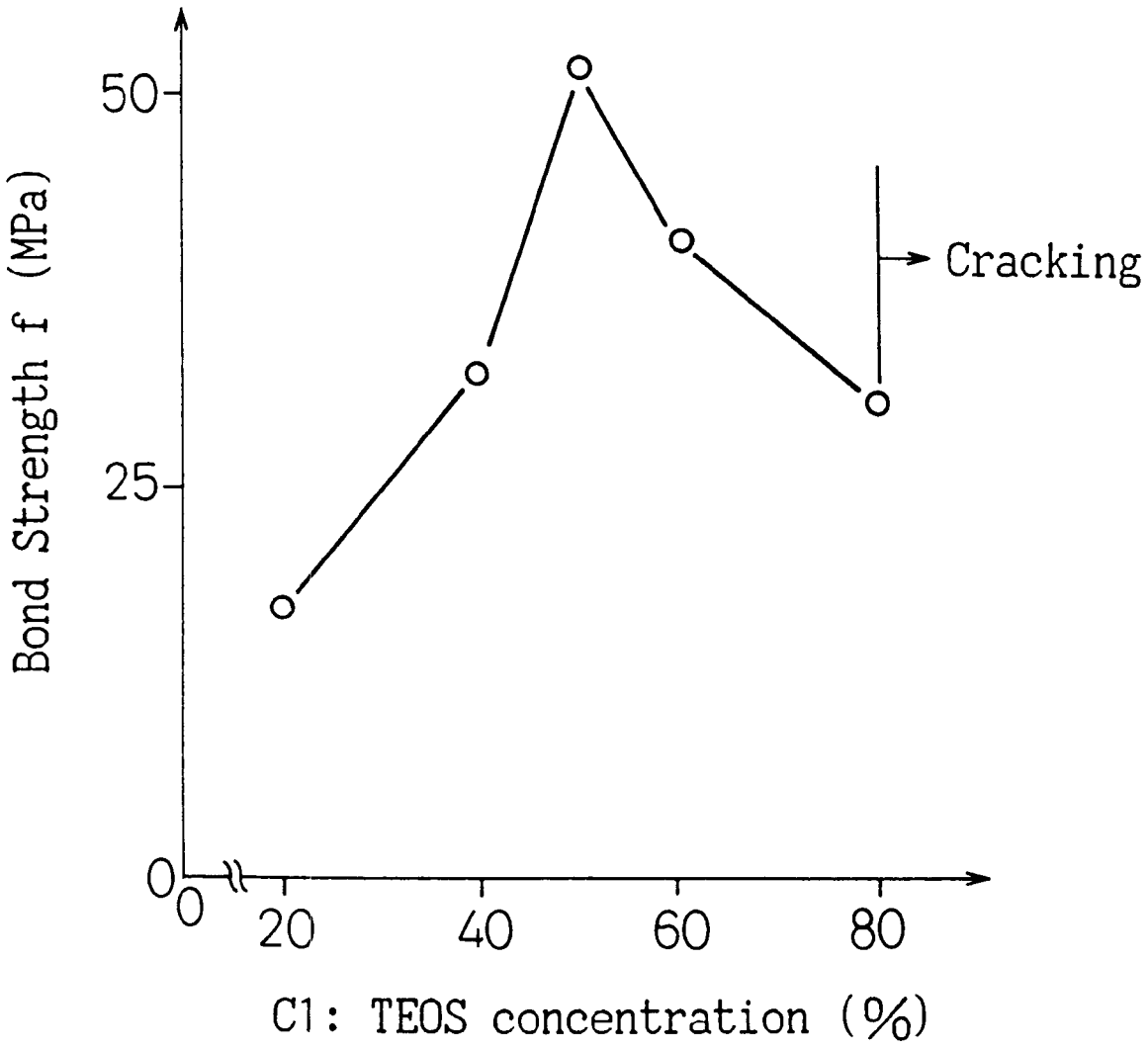
FIG. 17 is a graph showing the relationship between the metal alcoxide concentration C1 of slurry and the bond strength of porous nepheline mineral-based ceramic heat insulating layer.
Figure 18:
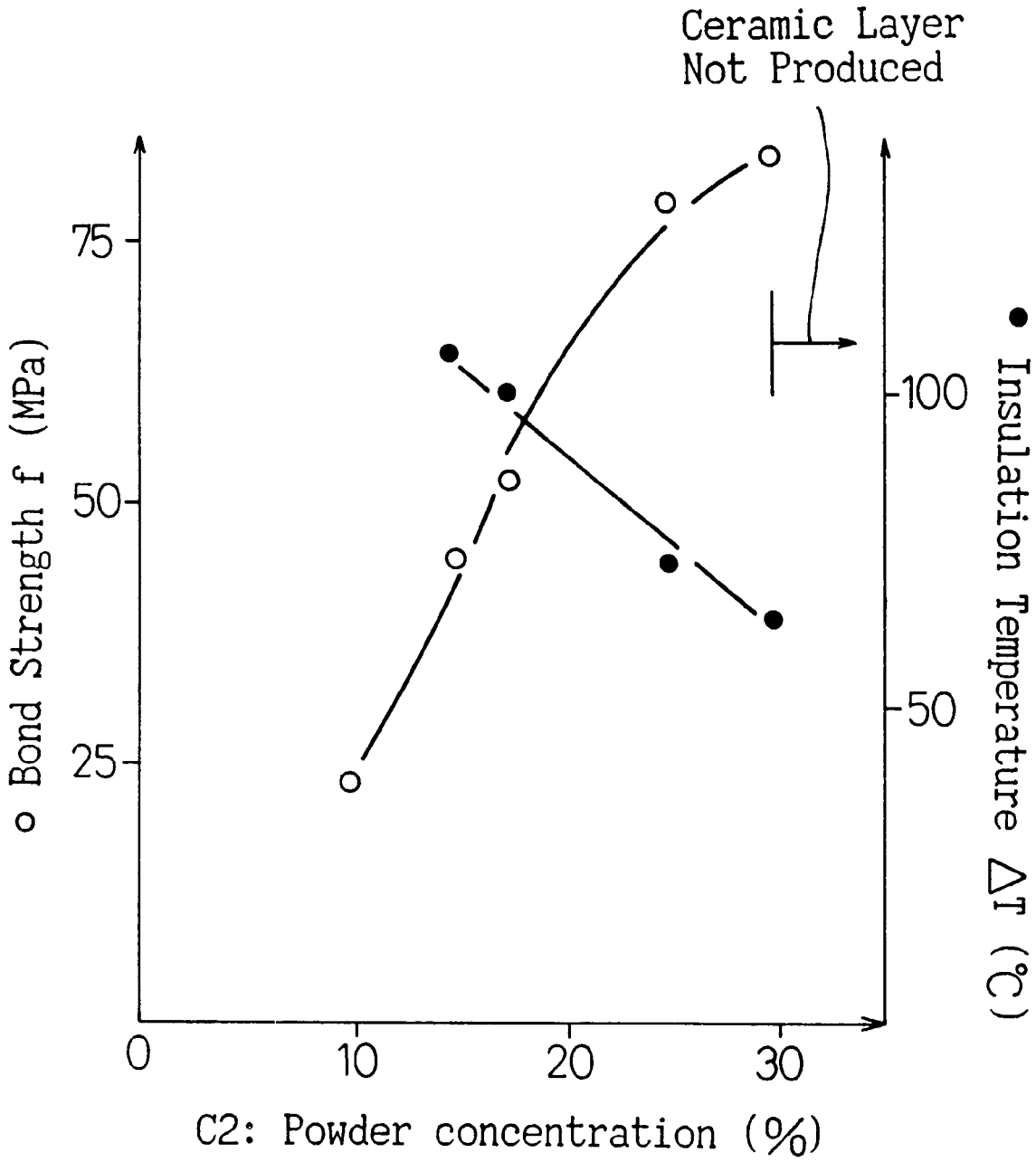
FIG. 18 is a graph showing the bond strength and the heat insulation of a porous nepheline mineral-based ceramic heat insulating layer in relation to the powder concentration (nepheline mineral powder concentration) C2 of slurry.
Figure 19:
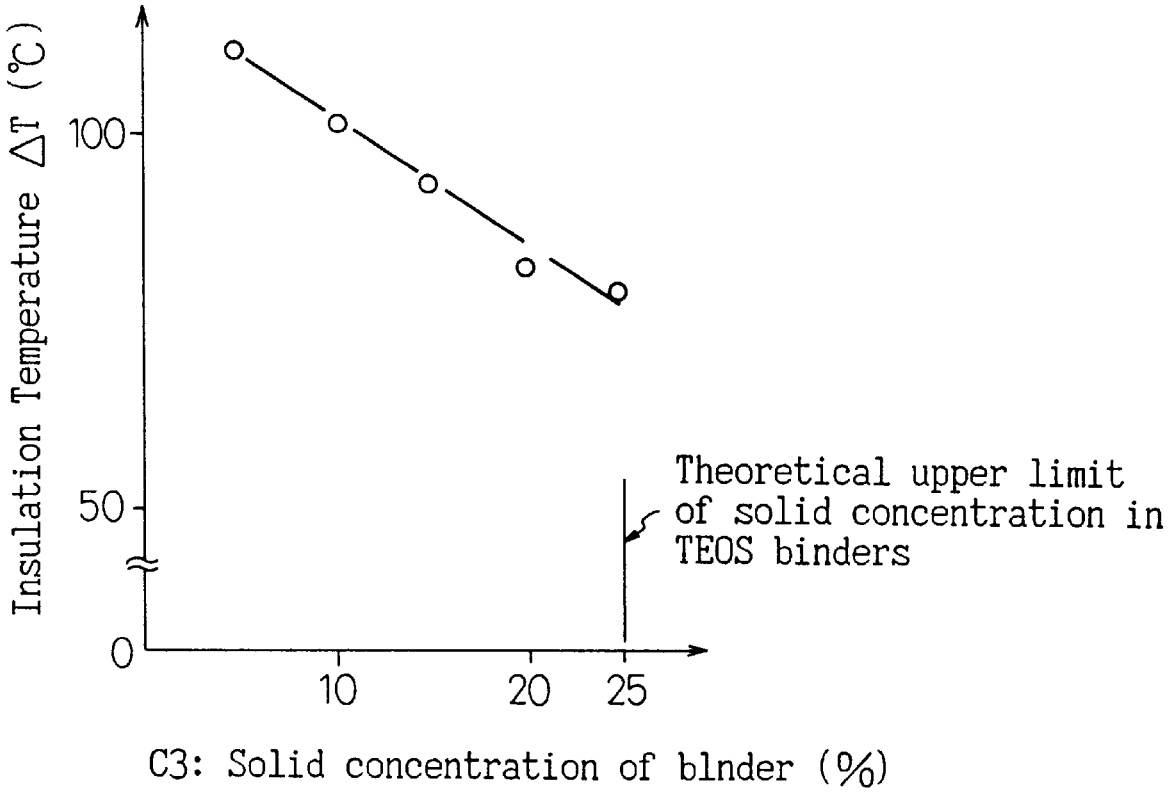
FIG. 19 is a graph showing the relationship between the heat insulation of a porous nepheline mineral-based ceramic heat insulating layer and the solid concentration of binder C3.

FIGS. 17, 18 and 19 shows the variations of the measured values in relation to the variations of C1, C2 and C3, respectively.

Referring to FIG. 17, in the region where the TEOS concentration C1 is low (i.e., the organosilicasol concentration is high), bonding is mainly effected by organosilicasol having fewer bonding hands per volume relative to those of TEOS and the bond strength f is low. The bond strength has a peak when C1=50% at which the TEOS binder 1 and the organosilicasol binder 2 are present in the same amount and is lowered at higher TEOS concentrations, and cracking occurs when the TEOS concentration is more than 80%. C1 is suitably within the range of from 40 to 60% to provide a bond strength substantially greater than 25 MPa achieved by the conventional iron oxide-based ceramic heat insulating layer.

Referring to FIG. 18, as the concentration of aggregate powder is increased, the ceramic layer is made more dense to provide an increased bond strength while the number of voids is decreased by the increased density to result in a reduced heat insulation. When the powder concentration is more than 30%, the amount of aggregate is excessive relative to that of binder and a ceramic heat insulating layer is not successfully formed. Referring to FIG. 19, the heat insulation is also reduced for the same reason as described above referring to FIG. 18. The powder concentration C2 is suitably within the range of from 15 to 20% and the binder solid component concentration C3 is suitably within the range of from 5 to 15% in order to ensure a bond strength f of at least 50 MPa or more and a heat insulation $\Delta T$ of at least 85° C., which values were achieved in Example 7, in which a ceramic heat insulating layer was formed directly on a base material as in this example. If C3 is less than the lower limit of 5%, the amount of binder solid component is too small to successfully form a ceramic heat insulating layer.

As described herein above, the present invention provides a ceramic heat insulating layer having an aggregate of a nephelin mineral realized by controllable preparation of a slurry free from the influence of alkaline metal ions characteristic to the nepheline mineral, thereby having a linear thermal expansion coefficient comparable with that of an iron-based member, an improved strength of bonding to the iron-based member or to a bonding layer formed on the member, and an improved heat resistance and strength.

We claim:

1. A ceramic heat insulating layer formed on an iron-based base material with or without an interposed bonding layer therebetween, comprising:

aggregate particles of a nepheline mineral, a binder composed of silica particles and a metalloxane polymer, the binder intervening between the aggregate particles to leave voids and chemically bonding the aggregate particles to each other and to the base material or to the bonding layer, and a sealing layer sealing the voids in a surface region of the ceramic heat insulating layer.

2. A ceramic heat insulating layer according to claim 1, further comprising chromium oxide particles.

3. A ceramic heat insulating layer according to claim 2, wherein the metalloxane polymer is a linear siloxane polymer.

4. A ceramic heat insulating layer according to claim 2, wherein the metalloxane polymer is a spherical siloxane polymer.

5. A ceramic heat insulating layer according to claim 1, wherein the aggregate particles of the nepheline mineral each have a coat of an inorganic oxide selected from a group consisting of alumina and silica.

6. A ceramic heat insulating layer according to claim 2, wherein the aggregate particles of the nepheline mineral each have a coat of an inorganic oxide selected from a group consisting of alumina and silica.

7. A process of forming a ceramic heat insulating layer on an iron-based base material with or without a bonding layer interposed therebetween, the process comprising:

mixing aggregate particles of a nepheline mineral, a binder of an alcoxide and an organosilicasol, and a dispersing medium to form a first slurry, applying the first slurry either on a surface of the iron-based base material, or on any bonding layer formed on the surface, firing the iron-based base material having the applied first slurry to form a first fired surface, forming a second slurry comprising Cr, applying the second slurry to the first fired surface, firing the iron-based base material having the applied second slurry in air, and forming the ceramic heat insulating layer of claim 1, wherein the mixing is either carried out in a sufficiently acidic or sufficiently alkaline solution such that a surface potential of particles dispersed in the first slurry does not pass an isoelectric point due to an increase in a pH value of the first slurry because of alkaline metal ions dissolved from the aggregate particles of the nepheline mineral, or the mixing is carried out after coating the aggregate particles of the nepheline mineral with a coating layer which prevents dissolution of alkaline metal ions from the aggregate particles of the nepheline mineral.

8. A process according to claim 7, wherein the first slurry further comprises chromium particles.

9. A process according to claim 8, wherein the mixing is carried out using the aggregate particles of the nepheline mineral held in suspension in an acid solution.

10. A process according to claim 9, wherein the acid solution is a solution of a carboxylic acid and an inorganic acid.

11. A process according to claim 10, wherein the carboxylic acid is an anhydrous carboxylic acid.

12. A process according to claim 7, wherein the first slurry further comprises at least one selected from the group consisting of polyamine, polyphosphine, and polyether.

13. A process according to claim 8, wherein, prior to the mixing, the pH value of a dispersed liquid composed of the binder and the dispersing medium is adjusted to 8 or more.

14. A process according to claim 7, wherein, prior to the mixing, an inorganic coating is formed on the aggregate particles of the nepheline mineral by an alcoxide.

15. A process according to claim 14, wherein hydroxyl groups are added to surfaces of the aggregate particles of the nepheline mineral before use.

16. A process according to claim 14, wherein hydrochloric acid is used as a nucleophilic reaction catalyst.

17. A process according to claim 14, wherein the firing of the iron-based base material having the applied first slurry is carried out in an inert atmosphere.

* * * * *